US006512501B1

(12) United States Patent
Nagaoka et al.

(10) Patent No.: US 6,512,501 B1
(45) **Date of Patent: *Jan. 28, 2003**

(54) METHOD AND DEVICE FOR DRIVING PLASMA DISPLAY

(75) Inventors: Keishin Nagaoka; Shigetoshi Tomio; Tadatsugu Hirose; Keiichi Kaneko; Shigeki Kameyama; Tomokatsu Kishi; Tetsuya Sakamoto; Takahiro Takamori; Akihiro Takagi, all of Kawasaki (JP)

(73) Assignee: Fujitsu Limited, Kawasaki (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 36 days.

(21) Appl. No.: 09/115,911

(22) Filed: Jul. 15, 1998

(30) Foreign Application Priority Data

Jul. 15, 1997 (JP) ..... 9-189443
Aug. 27, 1997 (JP) ..... 9-231039
Jul. 10, 1998 (JP) ..... 10-196016

(51) Int. Cl.[7] ..... G09G 3/28
(52) U.S. Cl. ..... 345/66
(58) Field of Search ..... 345/60, 68, 67; 315/169.4, 169.3, 169.1, 66

(56) References Cited

U.S. PATENT DOCUMENTS 5,075,597 A * 12/1991 Salavin et al. ..... 315/169.4
5,231,382 A 7/1993 Tanaka
5,436,634 A 7/1995 Kanazawa
5,446,344 A * 8/1995 Kanazawa ..... 315/169.4
5,461,395 A * 10/1995 Stein ..... 345/60
5,952,986 A * 9/1999 Nguyen et al. ..... 345/68
5,959,619 A * 9/1999 Kameyama et al. ..... 345/204
6,034,482 A * 3/2000 Kanazawa et al. ..... 345/211
6,052,101 A * 4/2000 Moon ..... 345/60
6,088,009 A * 7/2000 Moon ..... 345/60

FOREIGN PATENT DOCUMENTS

| | | |
|---|---|---|
| EP | 0 488 891 | 6/1992 |
| EP | 0 549 275 | 6/1993 |
| EP | 0 657 861 | 6/1995 |
| FR | 2 726 390 | 5/1996 |
| JP | 8-129357 | 5/1996 |
| KR | 98-4289 | 3/1998 |

* cited by examiner

*Primary Examiner*—Richard Hjerpe
*Assistant Examiner*—Ronald Laneau
(74) *Attorney, Agent, or Firm*—Staas & Halsey LLP

(57) ABSTRACT

A method for driving a plasma display panel applies, within a subfield among the n subfields, a narrow-width pulse having a pulse width equal to or less than 2 $\mu$s to first electrodes in order to cause an erase discharge while terminating a discharge caused between the first and second electrodes, and applies a voltage pulse to third electrodes so that the voltage pulse falls at the same time as the narrow-width pulse falls.

49 Claims, 32 Drawing Sheets

RESET PERIOD

SUSTAIN DISCHARGE PERIOD

ADDRESS PERIOD

PAUSE PERIOD

METHOD AND DEVICE FOR DRIVING PLASMA DISPLAY

BACKGROUND OF THE INVENTION

1. Field of the Invention

The present invention relates to a method and device for driving a plasma display.

Recently, in display devices, there has been activity in increasing the screen size up the display density and improvements in the capability of displaying a variety of information and the flexibility of placement conditions. Examples of such display devices are a plasma display panel (PDP), a cathode-ray tube (CRT), a liquid crystal display (LCD), an electro-luminescence (EL), a fluorescent display tube and a light-emitting diode. The key factor in the above activity in the development of display devices is to increase the display quality.

Particularly, there has been considerable activity in the development of the plasma display panel because it has various advantages such as no flicker noise, easy implementation of a large-size screen, high luminance and long lifetime. The plasma display panel is categorized in a dual-electrode type and a triple-electrode type. The dual-electrode type realizes a selective discharge (address discharge) and a sustain discharge by means of two electrodes. The triple-electrode type realizes the address discharge by using the third electrode. A color plasma display panel capable of realizing gradation display has a mechanism such that a fluorescent substance formed in a discharge cell is excited by a ultraviolet ray created by the discharge. However, there is a disadvantage in that the fluorescent substrate is susceptible to impact of ions of positive charges simultaneously generated by the discharge. The dual-electrode type has an arrangement in which the fluorescent substance is directly hit by the ions, and the lifetime thereof may thus be shortened.

The triple-electrode type utilizing a surface discharge can realize the color plasma display panel in which the above disadvantage is avoided. The triple-electrode type is categorized in a first arrangement and a second arrangement. In the first arrangement, the third electrodes is formed on a substrate on which the first and second electrodes for the sustain discharge are arranged. In the second arrangement, the third electrode is formed on another substrate opposite the substrate on which the first and second electrodes are arranged. The first arrangement is categorized in two types. The first type has the third electrode arranged above the two electrodes for the sustain discharge. The second type has the third electrode arranged under the two electrodes. There are also a transparent type and a reflection type. In the transparent type, visible light emitted from the fluorescent substance is viewed through the fluorescent substance. In the reflection type, visible light is viewed after it is reflected by the fluorescent substance. The cells in which a discharge takes place are spatially isolated from adjacent cells by means of a rib or barrier. The barrier is provided in a first or second arrangement. In the first arrangement, the barrier is provided on the four sides of each discharge cell and completely seals the discharge cell. In the second arrangement, the barrier is arranged only in one direction, spatial couplings in the other directions are implemented by an appropriate distance between the electrodes, in other words, an appropriate gap therebetween.

The present invention is concerned with the plasma display panels.

2. Description of the Related Art

The present specification is exemplarily directed to a plasma display panel having the following arrangement. The first and second electrodes for the sustain electrode are formed on a first substrate, and the third electrode is formed on a second subatrate opposite the first substrate. The barrier is formed only in the vertical direction, which is orthogonal to the first and second electrodes and is parallel to the third electrode. The sustain electrodes partially have a transparent electrode.

FIG. 1 is a schematic plan view of a plasma display panel having the above arrangement (which can be called a triple-electrode surface-discharge AC type plasma display panel). FIG. 2 schematically shows a vertical section of the plasma display panel, and FIG. 3 schematically shows a horizontal section thereof. FIGS. 2 and 3 show only one discharge cell.

The plasma display panel is generally formed of two glass plates. A front glass plate 18 is equipped with X electrodes 13 and Y electrodes 14, which function as sustain electrodes 19 extending in parallel. Each of the X electrodes 13 and the Y electrodes 14 is made up of a transparent electrode 19*a* and a bus electrode 19*b*. The transparent electrode 19*a* has a role of allowing reflected light coming from a fluorescent substance 17 to pass therethrough. In this regard, the transparent electrode 19*a* is formed of ITO (which a transparent conductive film having a main component of indium oxide). The bus electrode 19*b* is required to have a relatively low resistance in order to prevent occurrence of a voltage drop, and is thus made of, for example, Cr or Cu. The sustain electrodes 19 are covered by a dielectric layer (glass layer) 20. A MgO film 21 serving as a protection film is formed on a discharge surface of the dielectric layer 20.

A back glass plate 16 is opposite the front glass plate 18. Address (opposing) electrodes 15 are provided oan the back glass plate 16 so that the address electrodes 15 are orthogonal to the sustain electrodes 19. Barriers 11 are respectively provided between the address electrodes 15. The fluorescent substances 17 each having the red, green and blue light emitting performance are respectively provided between the barriers 11 so that the fluorescent substances 17 cover the respective address electrodes 15. The glass plates 16 and 18 are assembled into a unit so that the tops of the barriers 11 tightly contact the MgO film 21.

FIG. 4 is a waveform diagram of a conventional electrode driving operation on the plasma display panel shown in FIGS. 1 through 3. More particularly, FIG. 4 shows one subfield period in a conventional "address period/sustain discharge period separation type write address system".

In the example shown in FIG. 4, one subfield is segmented into a reset period, an address period and a sustain discharge period. During the reset period, all the Y electrodes $Y_1$–$Y_N$ are reset to 0 V, and simultaneously a whole screen write pulse of a voltage Vs+Vw (approximately equal to 330 V) is applied to the X electrodes. Hence, irrespective of the previous display state, all cells of all display lines are discharged. The potentials of the address electrodes at that time are approximately equal to 100 V (Vaw). Next. the potentials of the X electrodes and the address electrodes are changed to 0 V, a discharge is started in all the cells in such a way that the voltage of the wall charge itself exceeds a discharge starting voltage. In the above discharge, the wall charge is not formed because there is no potential difference between the electrodes. Hence, the space charge is self-neutralized and the discharge is ceased. That is, the self-erase discharge occurs. By the self-erase discharge, all the cells in the panel are changed to an even state having no wall charge. The reset period functions to set all the cells to the even state irrespective of the lighting states of the calls during the previous subfield. Hence, the next address (write) discharge can stably be caused.

In the address period subsequent to the reset period, the address discharge is caused in line-sequential formation in order to turn ON or OFF of the cells in accordance with display data. First, a scan pulse of a −Vy level (approximately equal to −150 V) is serially applied to the Y electrodes, and an address pulse of a voltage Va (approximately equal to 50 V) is selectively applied to address electrodes required to cause the sustain discharge, that is, the address electrodes corresponding to cells to be lighted. Hence, a discharge occurs between the address electrode and the Y electrode of each cell to be lighted. The above discharge functions as a priming, and immediately shifts to a discharge between the X electrode (voltage Vx is equal to 50 V) and the Y electrode. The former discharge will be referred to as priming address discharge, and the later discharge will be referred to as a main address discharge. Hence, a number of wall charges sufficient to realize the sustain discharge is accumulated in the MgO surface 21 on the X and Y electrodes.

The same operation as described above is carried out in each of the other display lines, new display data is written into all the display lines.

During the sustain discharge period subsequent to the address period, a sustain pulse of a voltage Vs (approximately equal to 180 V) is alternatively applied to the Y electrodes and the X electrodes. Hence, image of one subfield can be displayed. In the address period/sustain discharge separation type write address system, the luminescence depends on the length of the sustain discharge period, that is, the number of times that the sustain pulse is repeatedly applied.

FIG. 5 is a timing chart of the address period/sustain discharge separation type write address system, and more particularly exemplarily shows a display method for implementing a 16-gradation display. In the present example, one frame is segmented into four subfield SF1, SF2, SF3 and SF4, which have an identical reset period and an identical address period. The lengths of the sustain discharge in the subfields SF1, SF2, SF3 and SF4 have a ratio of 1:2:4:8. The 16-gradation display can be realized by selecting subfields to be lighted.

The subfields of the above-mentioned driving method have the respective reset periods, in each of the reset periods the whole screen write discharge is caused by applying the whole screen write pulse to the X electrodes. Hence, lighting is carried out during the reset period of each subfield, whereas the reset period does not contribute to image display. The above lighting serves as a factor which degrades the contrast of displayed image.

U.S. patent application Ser. No. 695,061 filed on Aug. 2, 1996 discloses an improved method having a reduced number of times per frame that the whole screen write pulse is repeatedly applied and realizing an improved contrast. The disclosure of the above application is hereby incorporated by reference. In the above method, the whole screen write discharge is caused only in some subfields, and only the erase discharge is caused for the reset periods of the remaining subfields. Hence, it is possible to reduce the number of times that the whole screen write discharge is repeatedly caused and to realize an improved contrast in which lighting which does not contribute to image display is suppressed.

The voltages of various pulses used to correctly light ON cells and not to light OFF cells at all have tolerable ranges. The minimum voltage level of each of the tolerable ranges and the maximum voltage level thereof define a respective drive voltage margin.

A first problem about the drive voltage margin will now be described. In narrow-width pulse erasing in the address electrodes of a simple matrix panel (dual poles), in order to cut an externally applied voltage during the time when a discharge is being formed, most charged particles created at the time of discharging remain in the discharge cell spaces. Then, the charged particles are adhered to the wall charges on the panel dielectric layer due to electrostatic attracting force, and are recombined and erased on the wall surfaces. In the triple-electrode panel having the surface discharge electrodes, the narrow-width pulse erasing operation is caused on the surface discharge electrodes on the identical plate. Hence, the charged particles in the discharge cell spaces are susceptible to the potentials of the address electrodes.

FIG. 6 shows residual wall charges, and more particularly shows that the address electrodes have a voltage Va while the neutralizing discharge using the narrow-width pulse takes place. In this case, a huge number of minus charges is accumulated on the address electrodes, and a failure in erasing thus takes place. FIG. 7 also shows residual wall charges, and more particularly shows the address electrodes are at the ground level GND while the neutralizing discharge using the narrow-width pulse takes place. In this case, a huge number of plus charges is accumulated on the address electrodes, and the erasing thus fails.

In the cases shown in FIGS. 6 and 7, the failure in erasing prevents selective formation of wall charges within the subsequent address period, and thus degrades the drive voltage margin.

A second problem about the drive voltage margin will now be described. In he erasing using the narrow-width pulse within the reset period, if the discharge is started earlier than the expected start timing due to an unevenness of the performance of the pixels and/or variations in the temperature condition, the wall charges may not be erased sufficiently. Additionally, wall charges may be formed which have the polarity opposite to the polarity which the charges have before the erasing. This degrades the drive voltage margin.

A description will now be given of a third problem about the drive voltage margin. FIG. 8 shows an influence by a very weak discharge, and more particularly shows the pulses respectively applied to the address, X and Y electrodes and a discharge light pulse. The discharge light pulses include a very weak light, which is located in the interval between the sustain discharge pulse and the next sustain discharge pulse. The very week discharge does not affect the next sustain discharge itself. Hence, the sustain discharge can certainly take place repeatedly.

However, the inventors found that the very weak discharge greatly affects the erase discharge (which uses the narrow-width pulse in FIG. 8) within the reset period. More paricularly, the very weak discharge decreases the wall charges formed by the sustain discharge, and prevents the normal erase discharge. Hence, the erasing of the wall charges fails. This reduces the drive voltage margin.

A description will now be given of a fourth problem about the drive voltage margin. The fourth problem is serious particularly in the high-contrast driving disclosed in the aforementioned patent. In the proposed high-contrast driving, only the erase discharge is made to take place within the reset period except for some subfields. The inventors found that if an erase pulse is applied so as to erase only cells which are lighted during the immediately previous subfield, the capability of erasing the residual wall charges on the address electrode is degraded as compared to the case where the whole screen with discharge causing the self-erase is employed. As an increased number of subfield has been processed, an increased number of residual wall charges is accumulated on the address electrodes. Hence, the whole screen write discharge for the next frame has an increased load. Hence, the cells do not have an even potential even after the whole screen write discharge is caused. Further, an increased load affects the following address discharges. The above thus decreases the drive voltage margin.

A fifth problem about the drive voltage margin will now be described. FIG. 5 which has been described shows the reset periods, address periods, sustain discharge periods and pause periods. A variation in the total time of the drive periods due to a variation in the number of times that the discharge sustain voltage pulse is repeatedly applied changes the pause periods. Hence, the discharges caused by the voltage pulse applied after the pause periods take place in different manners. Hence, the number of wall charges to be reset is changed, so that the drive voltage margin is degraded.

A sixth problem about the drive voltage margin will be described below. The sixth problem is serious particularly in the high-contrast driving. As has been described, only the erase discharge is caused during the reset period except for some subfields. A single voltage pulse used for the erase discharge cannot reset the charges completely. This leads to a failure in erasing and thus decreases the drive voltage margin.

The erasing of the wall charges using the erase pulse in which the voltage thereof is continuously changed uses a non-linear waveform depending on a resistor and a panel capacitance in order to use a simple circuit configuration. If the discharge takes place in a very slant portion of the waveform of the erase pulse, a failure in erasing takes place.

SUMMARY OF THE INVENTION

It is a general object of the present invention to provide a method and device for driving a plasma display in which the above disadvantages are eliminated.

A more specific object of the present invention is to provide a method and device for driving a plasma display having an improved drive voltage margin.

The above objects of the present invention are achieved by a method for driving a plasma display panel having first and second plates opposite each other, wherein first and second electrodes are formed on the first plate in parallel and third electrodes are formed on the second plate so as to be orthogonal to the first and second electrodes, and wherein one frame of image includes n subfields (n an integer), and each of the n subfield includes a reset period for causing an erase discharge to equalize states of wall charges in display cells of the panel, an address period for forming wall charges in the display cells, and a sustain discharge period for causing a sustain discharge based on the wall charges formed during the address period by repeatedly applying a sustain discharge pulse to the panel, said method comprising the steps of: applying, within a subfield among the n subfields, a narrow-width pulse having a pulse width equal to or less than 2 $\mu$s to the first electrodes in order to cause the erase discharge; and applying a voltage pulse to the third electrodes so that the voltage pulse falls at the same time as the narrow-width pulse falls. Hence, it is possible to solve the above-mentioned first problem and avoid an influence of the potential of the third electrodes at the time of performing the erase discharge using the narrow-width pulse.

The above method may be configured so that: the n subfields include a subfield A during which a whole screen discharge and the erase discharge are both caused, and a subfield B during which the erase discharge is caused without causing the whole screen discharge; and the erase discharge during the reset period of at least the subfield B is caused by the narrow-width pulse. Hence it is possible to solve the first problem and realize a stable operation without creating a large number of wall charges.

The above objects of the present invention are also achieved by a method for driving a plasma display panel wherein one frame of image includes n subfields, and each of the n subfields includes a reset period for causing an erase discharge to equalize states of wall charges in display cells of the panel, an address period for forming wall charges in the display cells, and a sustain discharge period for causing a sustain discharge based on the wall charges formed during the address period by repeatedly applying a sustain discharge pulse to the panel, said method comprising the steps of: applying, within the reset period, a narrow-width pulse having a pulse width equal to or less than 2 $\mu$s to the first electrodes in order to cause a first erase discharge; and applying, within the reset period, an erase pulse to the send electrodes in order to cause a second erase discharge, the erase pulse continuously changing a voltage applied to the second electrodes. Hence, it is possible to solve the second problem and to prevent erase wall charges having the inverted polarity.

The above method may be configured so that an interval between the narrow-width pulse and the erase pulse is equal to or greater than 10 $\mu$s. Hence, it is possible to reduce a variation in the number of wall charges and thus to more certainly perform the reset operation. Hence, it is possible to stabilize the wall charges which are instable due to the first erase discharge by the narrow-width pulse and more certainly erase the stabilized wall charges by the second erase discharge.

The above objects of the present invention are also achieved by a method for driving a plasma display panel wherein one frame of image includes n subfields, and each of the n subfields includes a reset period for causing an erase discharge to equalize states of wall charges in display cells of the panel, an address period for forming wall charges in the display cells, and a sustain discharge period for causing a sustain discharge based on the wall charges formed during the address period by repeatedly applying a sustain discharge pulse to the panel, said method comprising the step of: repeatedly applying, within a given subfield among the n subfields, the sustain discharge pulse so that a last sustain discharge pulse within the sustain discharge period has a pulse width longer than remaining sustain discharge pulses applied within the sustain discharge period. Hence it is possible to solve the third problem and to cause charged particles created by the sustain discharge pulses to be wall charges. Hence the priming effect due to space charges can be reduced. Thus, it is possible to prevent a very week discharge from occurring after the last sustain discharge pulse within the sustain discharge period.

The above method be configured so that: the n subfields include a subfield A during which a whole screen discharge and the erase discharge are both caused, and a subfield B during which the erase discharge is caused without causing the whole screen discharge; and said given subfield is disposed immediately before the subfield B. It is thus possible to prevent a very weak discharge from occurring after the last sustain discharge pulse within the sustain discharge period.

The above objects of the present invention are also achieved by a method for driving a plasma display panel wherein one frame of image includes n subfields, and each of the n subfields includes a reset period for causing an erase discharge to equalize states of wall charges in display cells of the panel, an address period for forming wall charges in the display cells, and a sustain discharge period for causing a sustain discharge based on the wall charges formed during the address period by repeatedly applying a sustain discharge pulse to the panel, said method comprising the step of: applying, within a given subfield among the n subfields, an erase pulse for causing the erase discharge within the reset period at a first interval from a last sustain discharge pulse in the subfield located immediately before the given subfield, said first interval being equal to a second interval at which sustain discharge pulses repeatedly applied are arranged. It is thus possible to prevent, even if a very weak discharge is caused, the erase discharge from being affected by the very weak discharge.

The above method may be configured so that: the n subfields include a subfield A during which a whole screen discharge and the erase discharge are both caused, and a subfield B during which the erase discharge is causes without causing the whole screen discharge; and said given subfield corresponds to the subfield B. It is thus possible to prevent, even if a very weak discharge is caused in the subfield B, the erase discharge from being affected by the very weak discharge.

The above method may be configured so that an interval between the erase pulse in the subfield B and the last sustain discharge pulse located immediately before said subfield B is equal to or less than 2 $\mu$s. Hence it is possible to perform the erase discharge in the next subfield B immediately after the last sustain discharge pulse is applied.

The above objects of the present invention are also achieved by a method for driving a plasma display panel wherein one frame of image includes n subfields, and each of the n subfields includes a reset period for causing an erase discharge to equalize states of wall charges in display cells of the panel, an address period for forming wall charges in the display cells, and a sustain discharge period for causing a sustain discharge based on the wall charges formed during the address period by repeatedly applying a sustain discharge pulse to the panel, said method comprising the step of: applying a voltage pulse to the third electrodes so that the voltage pulse falls at the same time as a last sustain discharge pulse is applied within the sustain discharge period of a subfield located immediately before the reset period of a subfield within which no whole screen write discharge is caused. Hence it is possible to equalize the wall charges on the third electrodes and to more certainly perform the reset operation.

The above objects of the present invention are achieved by a method for driving a plasma display panel wherein one frame of image includes n subfields, and each of the n subfields includes a reset period for causing an erase discharge to equalize states of wall charges in display calls of the panel, an address period for forming wall changes in the display cells, and a sustain discharge period for causing a sustain discharge based on the wall charges formed during the address period by repeatedly applying a sustain discharge pulse to the panel, said method comprising the step of: repeatedly applying the sustain discharge pulse within the sustain discharge period at an interval equal to or less than 1 $\mu$s. Hence, it is possible to perform the sustain discharge before the space charges due to a very weak discharge are settled to wall discharges. Thus the wall charges on the third electrodes can be reduced and the lead on the erase discharge caused during the reset period can be reduced.

The above objects of the present invention are also achieved by a method for driving a plasma display panel having first and second plates opposite each other, wherein first and second electrodes are formed on the first plate in parallel and third electrodes are formed on the second plate so as to be orthogonal to the first and second electrodes, and wherein one frame of image includes n subfields, and each of the n subfields includes a reset period for causing an erase discharge to equalize states of wall charges in display calls of the panel, an address period for forming wall charges in the display cells, and a sustain discharge period for causing a sustain discharge based on the wall charges formed during the address period by repeatedly applying a sustain discharge pulse to the panel, said method comprising the step of: causing, within the reset period of a subfield A among the n subfields, both a whole screen write discharge and the erase discharge so that the erase discharge is caused first aid the whole screen write discharge is caused second. Hence it is possible to solve the fourth problem and to set the residual wall charges to an identical state before the whole screen write discharge. Thus, the load on the whole screen write discharge can be reduced. Hence it is possible to more perfectly erase the charges accumulated an the third electrodes.

The above method may be configured so that it further comprises the step of causing, within the reset period of a subfield B among the n subfields, only the erase discharge without the whole screen discharge. Hence it is possible to solve the fourth problem and to set the residual wall charges to an identical state before the whole screen write discharge. Thus, the load on the whole screen write discharge can be reduced. Hence it is possible to more perfectly erase the charges accumulated on the third electrodes.

The above method may be configured so that it further comprises the step of causing the erase discharge before the whole screen write discharge by repeatedly applying a narrow-width pulse having a pulse width equal to or less than 2 $\mu$s to the first electrodes or repeatedly applying an erase pulse continuously changing a voltage applied to the second electrodes or by repeatedly applying both the narrow-width pulse and the erase pulse. Hence it is possible to solve the fourth problem and to set the residual wall charges to an identical state before the whole screen write discharge. Thus, the load on the whole screen write discharge can be reduced. Hence it is possible to more perfectly erase the charges accumulated on the third electrodes.

The above method may be configured so that: the erase discharge is caused within the reset period before the whole screen write discharge is caused; and a voltage of 0 V is applied to the third electrodes when the erase discharge is caused. Thus, the load on the whole screen write discharge can be reduced. Hence it is possible to more perfectly erase the charges accumulated on the third electrodes.

The above method may be configured so that the n subfields include a subfield A during which the whole screen discharge and the erase discharge are both caused during the reset period, and a subfield B during which the erase discharge is caused without causing the whole screen discharge during the reset period. Thus, the load on the whole screen write discharge can be reduced. Hence it is possible to more perfectly erase the charges accumulated on the third electrodes.

The above objects of the present invention are also achieved by a method for driving a plasma display panel having first and second plates opposite each other, wherein first and second electrodes are formed on the first plate in parallel and third electrodes are formed on the second plate so as to be orthogonal to the first and second electrodes, and wherein one frame of image includes n subfields, and each of the n subfields includes a reset period for causing an erase discharge to equalize states of wall charges in display cells of the panel, an address period for forming wall charges in the display cells, and a sustain discharge period for causing a sustain discharge based on the wall charges formed during the address period by repeatedly applying a sustain discharge pulse to the panel, said method comprising the step of: causing, within the reset period of a subfield A among the n subfields, both a whole screen write discharge and the erase discharge by applying a narrow-width pulse equal to or less than 2 $\mu$s to the third electrodes to cause the erase discharge after a whole screen write pulse causing the whole screen write discharge falls. Hence it is possible to erase the charges accumulated on the third electrodes more completely and to equalize the wall charges.

The above method may further comprise the step of applying the narrow-width pulse to the third electrodes within 10 $\mu$s after the whole screen pulse falls. Hence it is possible to erase the charges accumulated on the third electrodes more completely and to certainly equalize the wall charges.

The above method may further comprise the step of applying, within the reset period, an erase pulse continuously changing a voltage applied to the second electrodes after the whole screen write pulse falls. Hence it is possible to erase the charges accumulated on the third electrodes more completely and to certainly equalize the wall charges.

The above objects of the present invention are achieved by a method for driving a plasma display panel wherein one frame of image includes n subfields weighted, and each of the n subfields includes a reset period for causing an erase discharge to equalize states of wall charges in display cells of the panel, an address period for forming wall charges in the display cells, and a sustain discharge period for causing a sustain discharge based on the wall charges formed during the address period by repeatedly applying a sustain discharge pulse to the panel, the sustain discharge period of each of the n subfields being based on weighting applied thereto, said method comprising the steps of: causing, within the reset period of a subfield A among the n subfields, both a whole screen write discharge and the erase discharge; and causing, within the reset period of a subfield B among the n subfields, the erase discharge without the whole screen write discharge, the reset period within which both the whole screen write discharge and the erase discharge are caused being disposed after a shortest sustain discharge period defined by the weighting. Hence it is possible to solve the fourth problem and to set the residual wall charges to an identical state before the whole screen write discharge. Thus, the load an the whole screen write discharge can be reduced. Hence it is possible to more perfectly erase the charges accumulated on the third electrodes.

The above objects of the present invention are also achieved by a method for driving a plasma display panel wherein one frame of image includes n subfields weighted, and each of the n subfields includes a reset period for causing an erase discharge to equalize states of wall charges in display cells of the panel, an address period for forming wall charges in the display cells, and a sustain discharge period for causing a sustain discharge based on the wall charges formed during the address period by repeatedly applying a sustain discharge pulse to the panel, the sustain discharge period of each of the n subfields being based on weighting applied thereto, said method comprising the steps of: causing, within the reset period of a subfield A among the n subfields, both a whole screen write discharge and the erase discharge; and causing, within the reset period of a subfield B among the n subfields, the erase discharge without the whole screen write discharge, the reset period within which both the whole screen write discharge and the erase discharge are caused being disposed after a longest sustain discharge period defined by the weighting. Hence, the whole screen write discharge is caused when the largest number of charges is accumulated on the third electrodes. Thus it is possible to efficiently perform the whole screen write discharge and to more completely erase the charges accumulated on the third electrodes.

The above objects of the present invention are also achieved by a method for driving a plasma display panel wherein one frame of image includes n subfields weighted and a pause period during which no drive pulses are output, and each of the n subfields includes a reset period for causing an erase discharge to equalize states of wall charges in display cells of the panel, an address period for forming wall charges in the display cells, and a sustain discharge period for causing a sustain discharge based on the wall charges formed during the address period by repeatedly applying a sustain discharge pulse to the panel, the sustain discharge period of each of the n subfields being based on weighting applied thereto, said method comprising the step of: causing, within the reset period of a subfield A among the n subfields, both a whole screen write discharge and the erase discharge, said pause period being a self-erasing period after a whole screen write pulse for causing the whole screen write discharge is caused. Hence it is possible to solve the fifth problem and to reduce a variation in a drive voltage margin dependent on the length of the pause period.

The above method may further comprise the step of causing, within the reset period of a subfield B among the n subfields, the erase discharge without the whole screen write discharge, the pause period being located after the subfield A. Hence it is possible to more effectively reduce a variation in a drive voltage margin dependent on the length of the pause period.

The above objects of the present invention are also achieved by a method for driving a plasma display panel having first and second plates opposite each other, wherein first and second electrodes are formed on the first plate in parallel and third electrodes are formed on the second plate so as to be orthogonal to the first and second electrodes, and wherein one frame of image includes n subfields, and each of the n subfields includes a reset period for causing an erase discharge to equalize states of wall charges in display cells of the panel, an address period for forming wall charges in the display cells, and a sustain discharge period for causing a sustain discharge based on the wall charges formed during the address period by repeatedly applying a sustain discharge pulse to the panel, said method comprising the steps of: applying, within the reset period, a narrow-width pulse having a pulse width equal to or less than 2 $\mu$s to the first electrodes; and applying, within the reset period, erase pulses continuously changing a voltage applied to the second electrodes so that a first erase pulse continuously changing the voltage in a positive direction is applied after the narrow-width pulse is applied, and then a second erase pulse continuously changing the voltage in a negative direction or an erase pulse in the negative direction is applied to the second electrodes. Hence it is possible to solve the sixth problem and to more certainly erase the residual wall charges before the address selective discharge and improve the drive voltage margin.

The above method may be configured so that it further comprises the step of applying a third erase pulse continuously changing the voltage in the positive direction. Hence it is possible to more certainly erase the residual wall charges before the address selective discharge and improve the drive voltage margin.

The above method may be configured so that an n+1th erase pulse has a pulse width longer than that of an nth erase pulse. Hence it is possible to solve the sixth problem and to more certainly erase the residual wall charges before the address selective discharge and improve the drive voltage margin.

The above objects of the present invention are also achieved by a method for driving a plasma display panel having first and second plates opposite each other, wherein first and second electrodes are formed on the first plate in parallel and third electrodes are formed on the second plate so as to be orthogonal to the first and second electrodes, and wherein one frame of image includes n subfields, and each of the n subfields includes a reset period for causing an erase discharge to equalize states of wall charges in display cells of the panel, an address period for forming wall charges in the display cells, and a sustain discharge period for causing a sustain discharge based on the wall charges formed during the address period by repeatedly applying a sustain discharge pulse to the panel, said method comprising the steps of: applying, within the reset period, a narrow-width pulse having a pulse width equal to or less than 2 $\mu$s to the first electrodes; and applying, within the reset period, erase pulses continuously changing a voltage applied to the second electrodes so that a first erase pulse continuously changing the voltage in a positive direction is applied after the narrow-width pulse is applied, and then a second erase pulse continuously changing the voltage in a position direction is applied to the first electrodes. Hence it is possible to solve the sixth problem and to more certainly erase the residual wall charges before the address selective discharge and improve the drive voltage margin.

It may be preferable that the erase pulses steeply rise. However, in practice, the erase pulses are generated by a resistor and a panel capacitor and rise non-linearly. In this case, it is desired that discharge takes place in a gentle portion of the waveforms of the erase pulses. With the above in mind, there is provided a method for driving a plasma display panel having first and second plates opposite each other, wherein first and second electrodes are formed on the first plate in parallel and third electrodes are formed on the second plate so as to be orthogonal to the first and second electrodes, and wherein one frame of image includes n subfields, and each of the n subfields includes a reset period for causing an erase discharge to equalize states of wall charges in display cells of the panel, an address period for forming wall charges in the display cells, and a sustain discharge period for causing a sustain discharge based on the wall charges formed during the address period by repeatedly applying a sustain discharge pulse to the panel, said method comprising the step of: consecutively applying, within the reset period, a plurality of reset pulses which erase wall charges and continuously change a voltage applied to any of the first, second and third electrodes in order to cause a discharge at a voltage close to a discharge start voltage. Hence, it is possible to stably and certainly erase (reset) the wall charges in the cells having different discharge start voltages at voltages close to the respective discharge start voltages.

The above method may further comprise the steps of: applying the plurality of reset pulses to the first electrodes; and setting the second voltages to different potentials respectively corresponding to the plurality of reset pulses. Hence, it is possible to stably and certainly erase the wall charges in the cells having different discharge start voltages at voltages close to the respective discharge start voltages.

The above method may further comprise the steps of: applying the plurality of reset pulses to the first electrodes; and setting the third voltages to different potentials respectively corresponding to the plurality of reset pulses. Hence, it is possible to stably and certainly erase (reset) the wall charges in the cells having different discharge start voltages at voltages close to the respective discharge start voltages.

The above method may be configured so that the plurality of reset pulses have an identical voltage slope. Thus, a simple circuit can be used which generates the reset pulses.

The above method may be configured so that a maximum potential difference between the first and second electrodes in response to an n+1th reset pulse among the plurality of reset pulses is greater than that in response to an nth reset pulse among them. Hence, it is possible to reset calls having relatively low discharge start voltages first and to reset cells having relatively high discharge start voltages second.

The method may be configured so that a maximum potential difference between the first and third electrodes in response to an n+1th reset pulse among the plurality of reset pulses is greater than that in response to an nth reset pulse among them. Hence, it is possible to reset cells having relatively low discharge start voltages first and to reset cells having relatively high discharge start voltages second.

The method may be configured so that at least one of the potentials of the second electrodes based on the respective reset pulses is equal to a potential of the second electrodes set during the address period. Hence, a simple circuit can be used which controls the potential of the second electrodes.

The method may he configured so that at least one of the potentials of the third electrodes based on the respective reset pulses is equal to a potential of the third electrodes set during the address period. Hence, a simple circuit can be used which controls the potential of the third electrodes.

The above objects of the present invention are also achieved by a device adapted to a plasma display panel having first and second plates opposite each other, wherein first and second electrodes are formed on the first plate in parallel and third electrodes are formed on the second plate so as to be orthogonal to the first and second electrodes, said device comprising: a first control part which drives the plasma display panel wherein one frame of image includes n subfields, and each of the n subfield includes a reset period for causing an erase discharge to equalize states of wall charges in display cells of the panel, an address period for forming wall charges in the display cells, and a sustain discharge period for causing a sustain discharge based on the wall charges formed during the address period by repeatedly applying a sustain discharge pulse to the panel; a second control part which consecutively applies, within the reset period, a plurality of reset pulses which erase wall charges and continuously change a voltage applied to any of the first, second and third electrodes in order to cause a discharge at a voltage close to a discharge start voltage. Hence, it in possible to stably and certainly erase the wall charges in the cells having different discharge start voltages at voltages close to the respective discharge start voltages.

BRIEF DESCRIPTION OF THE DRAWINGS

Other objects, features and advantages of the present invention will become more apparent from the following detailed description when read in conjunction with the accompanying drawings, in which.

DESCRIPTION OF THE PREFERRED EMBODIMENTS

A description will be given of embodiments of the present invention with reference to the accompanying drawings.

Figure 9:
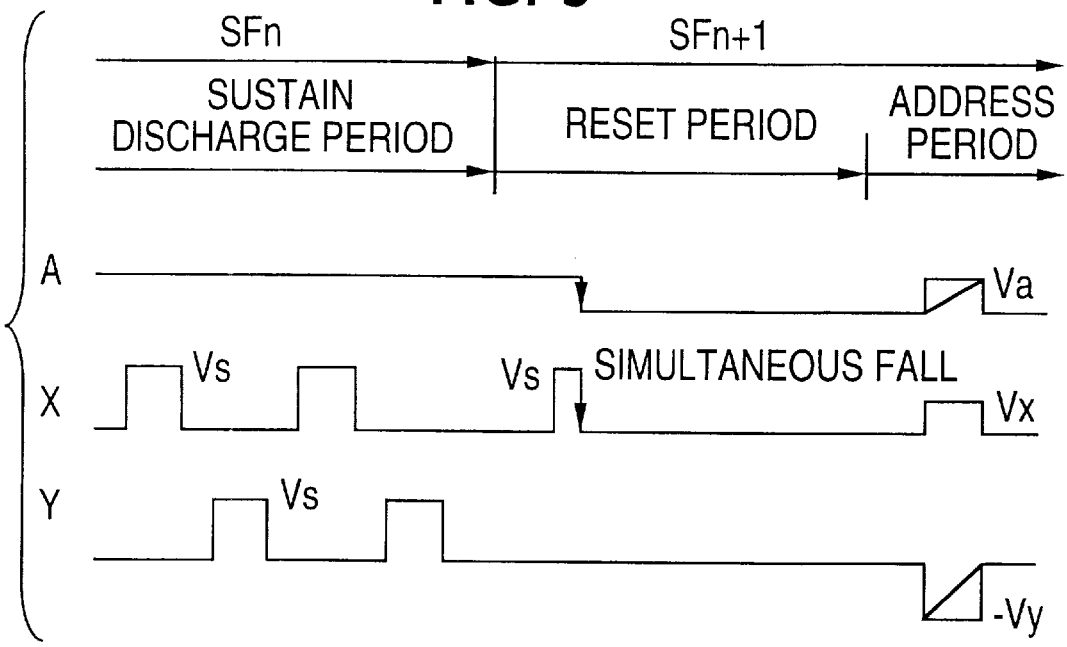
FIG. 9 is a waveform diagram of drive pulses according to a first embodiment of the present invention.
Figure 10:
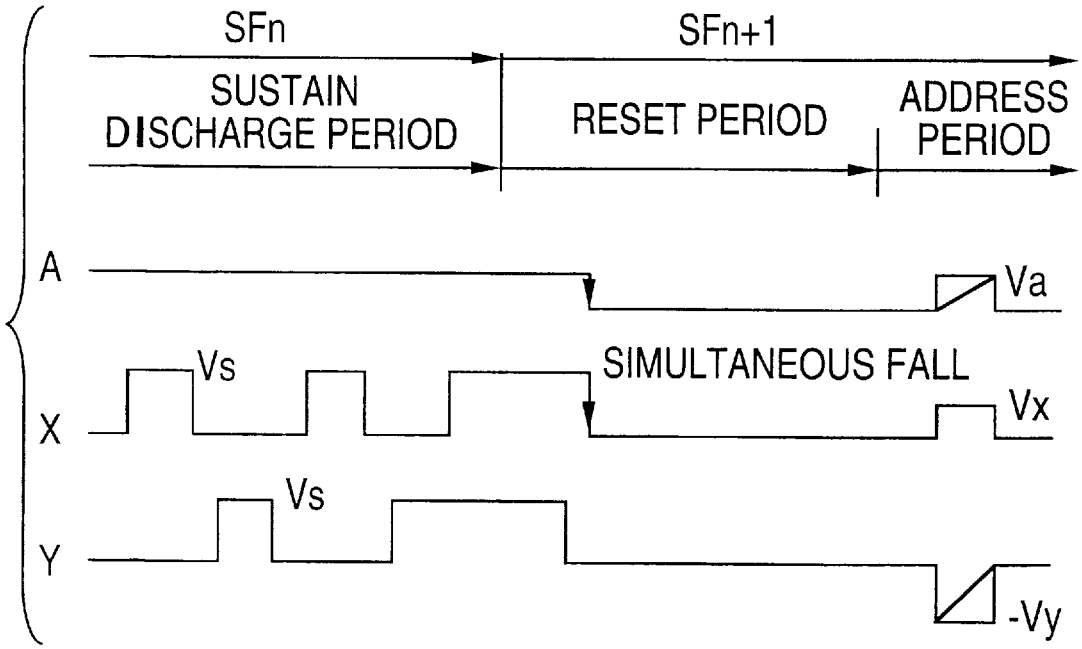
FIG. 10 is a waveform diagram of drive pulses according to a second embodiment of the present invention.

FIGS. 9 and 10 are respectively waveform diagrams of drive signals according to first and second embodiments of the present invention. The first and second embodiments of the present invention are applied to the aforementioned high-contrast drive method. More particularly, the whole screen write discharge is not caused in subfield SFn+1. Instead, an erase pulse, which is a narrow-width pulse (which has a pulse width equal to or less than, for example, 2 $\mu$s), is applied to the X electrodes in order to erase the wall charges. The narrow-width pulse is directed to terminating the application of the pulse voltage immediately after the discharge formation is completed. Most charged particles created at the time of discharging remain in the discharge cell spaces, and are adhered to the wall charges on the dielectric layer in the panel due to electrostatic attracting force. Then, the charged particles are recombined on the wall surfaces and are thus erased. The above holds true for the following embodiments of the present inventions.

It is known that the panel can stably operate by setting the potentials of the address electrodes during the sustain discharge period in the triple-electrode type panel to an intermediate level of the potential difference between the X and Y electrodes involved in the sustain discharge. Hence, the address electrodes are maintained at a positive potential during the sustain discharge period. The use of the intermediate potential is also employed at the time of the erase discharge using the narrow-width pulse (equal to or less than 2 $\mu$s).

In the first and second embodiments of the present invention, the erase discharge is caused by applying the narrow-width pulse to the address electrodes, so that the potentials of the address electrodes at the time when the wall charges are formed is set to the potential difference Va between the electrodes involved in the sustain discharge. Further, the potential Va of the address electrodes falls at the same time as the narrow-width pulse rises. Furthermore, the potential at the time of the neutralizing discharge created by the fall of the narrow-width pulse is set to the ground level GND. Thus, it is possible to avoid the aforementioned influence of the potential of the address electrodes at the time of the erase discharge using the narrow-width pulse.

The second embodiment of the present invention shown in FIG. 10 corresponds to a variation of the first embodiment thereof shown in FIG. 9. The waveforms of the drive pulses themselves applied to the X and Y electrodes shown in FIG. 10 are different from corresponding those shown in FIG. 9. However, the potential difference between the X and Y electrodes used in the second embodiment is the same as that used in the first embodiment, and it can thus be said that the drive methods of the first and second embodiments are substantially identical to each other.

According to the first and second embodiments of the present invention, it is possible to avoid a large numbers of minus (or plus) charges from being accumulated by the influence of the potential of the address electrodes and to thus realize the complete erasing. Hence, the drive voltage margin can be improved.

Although the first and second embodiments of the present invention are applied to the high-contrast driving method, the concept of these embodiments is not limited thereto. For example, the same effects as described above can be obtained in a case where the whole screen write discharge and the erase discharge using the narrow-width pulse are caused during the reset periods of all the subfields. Further, the first and second embodiments will be effective to another case where only the erase discharge using the narrow-width pulse is caused without the whole screen write discharge during the reset periods of all the subfields.

Figure 11:
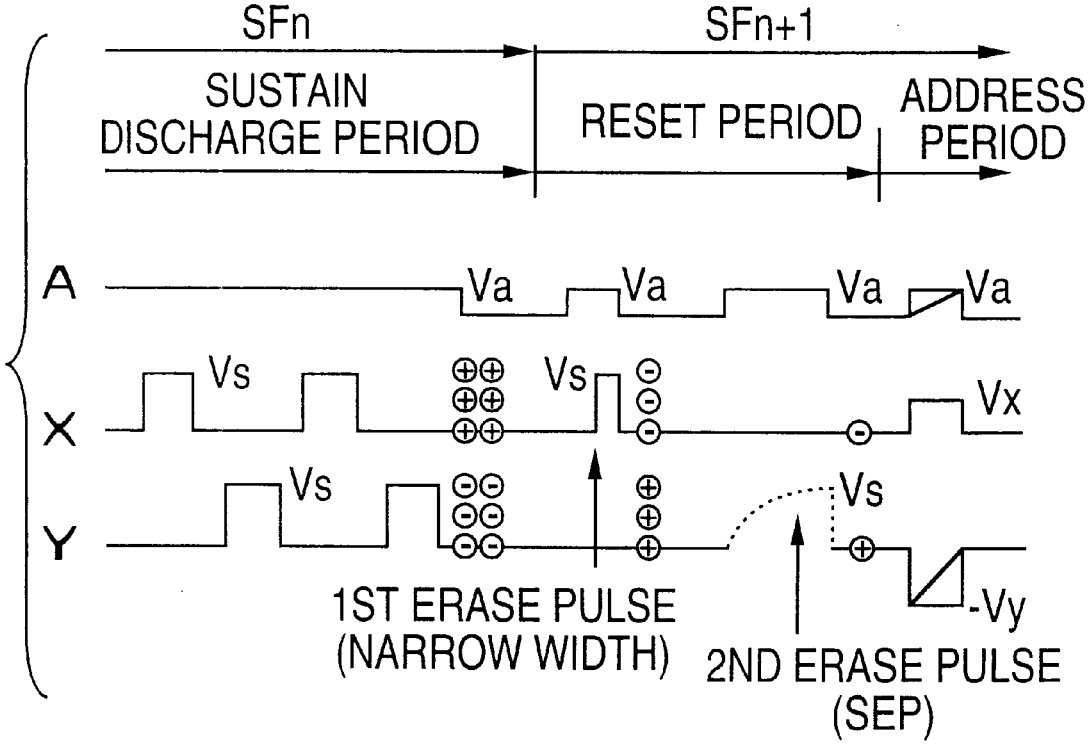
FIG. 11 is a waveform diagram of drive pulses according to a third embodiment of the present invention.

FIG. 11 is a waveform diagram of drive pulses according to a third embodiment of the present invention, which is exemplarily applied to the high-contrast driving method. In the cells involved in the last sustain discharge in the nth subfield SFn, plus charges are accumulated in the X electrodes, and minus charges are accumulated in the Y electrodes. FIG. 11 schematically shows the number of plus charges accumulated on the X electrodes and the number of minus charges accumulated on the Y electrodes in order to facilitate understanding how many charges are accumulated thereon. In the next subfield SFn+1, the whole screen write discharge is not caused, but the narrow-width pulse which functions as a first erase pulse is applied to the X electrodes, whereby the wall charges are erased.

At that time, if the discharge is started earlier than the expected timing due to unevenness of the performance of the pixels and/or variations in the temperature condition, wall charges which have the polarity opposite to the polarity which the wall charges have before the erasing will be accumulated on the x and Y electrodes. In FIG. 11, the wall charges are accumulated on the X and Y electrodes although the numbers of these wall charges are reduced.

According to the third embodiment of the present invention, a slope erase pulse SEP, which functions as a second erase pulse, is used to almost completely erase the wall charges. It is preferable that the slope erase pulse (second erase pulse) be located so as to lag behind the narrow-width pulse (first erase pulse) by 10 $\mu$s or more. This is because the erase operation will be executed in an unstable state of charges if the interval between the first and second erase pulses is less than 10 $\mu$s. The slope erase pulse is, for example, a pulse which is simply generated by the combination of a resistance and a panel capacitance and which has a comparatively steeply slope portion and a comparatively gentle slope portion like an exponential curve.

As shown in FIG. 11, very small numbers of wall changes remain on the X and Y electrodes after the erasing operation using the first and second erase pulses. Such very small numbers of residual charges do not affect the subsequent address period.

The second erase pulse, namely, the slope erase pulse SEP, does not erase the wall charges as many as the narrow-width pulse. However, the second erase pulse does not cause the polarity inversion of charges. For this reason, it is preferable to use the second erase pulse. The second erase pulse, namely, the slope erase pulse has a gentle rising slope. The cells having respective discharge voltages are individually discharged when the voltage of the slope erase pulse reaches the respective discharge voltages. Hence, the cells receive respective optimal discharge voltages (approximately equal to the respective discharge start voltages). Hence, there is no possibility that polarity-inverted charges remain in the cells.

According to the third embodiment of the present invention, it is possible to almost completely erase the wall charges during the reset period and to thus improve the drive voltage margin. The third embodiment is effective to a case where only the erase discharge using the narrow-width pulse is caused without the whole screen write discharge within the reset period. It is also possible to employ, other than the sequential combination of the narrow-width pulse and the slope erase pulse, other sequential combinations of two narrow-width pulses, two slope erase pulses, and a slope erase pulse and a narrow-width pulse.

Figure 12:
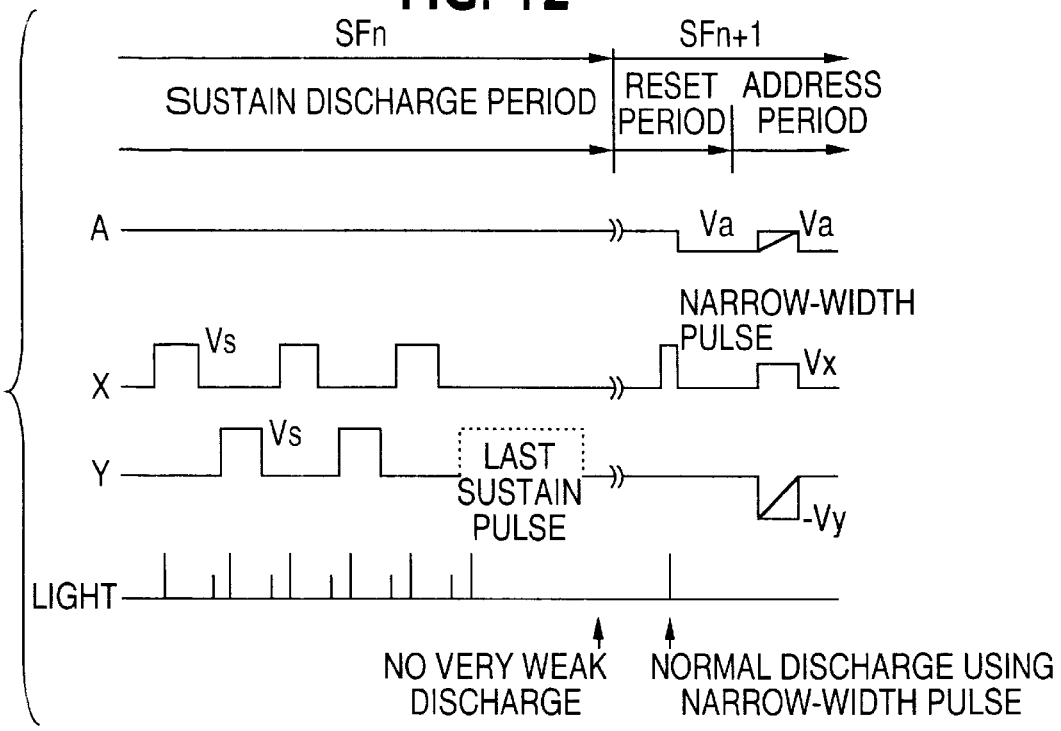
FIG. 12 is a waveform diagram of drive pulses according to a fourth embodiment of the present invention.

FIG. 12 is a waveform diagram of drive pulses according to a fourth embodiment of the present invention, which is exemplarily applied to the high-contrast driving method. More particularly, in the subfield SFn+1, the whole screen write discharge is not caused, but the erase pulse which is the narrow-width pulse is applied to the X electrodes in order to erase the wall charges. As has been described with reference to FIG. 8, the very weak discharges occur after the sustain pulses fall in the sustain discharge periods. Particularly, the very weak discharge which occurs after the last sustain discharge pulse falls affects the subsequent erase discharge.

According to the fourth embodiment of the present invention, the last sustain discharge pulse has a comparatively long pulse width, as shown in FIG. 12. Hence, the last sustain discharge pulse prevents the very weak discharge from occurring after it falls, and the erase discharge using the narrow-width pulse can normally be caused. The experiments conducted by the inventors show the last sustain discharge pulse has a pulse width equal to or longer than 3 $\mu$s in order to prevent occurrence of a very weak discharge.

According to the fourth embodiment, it is possible to prevent occurrence of a failure in erasing caused by the very weak discharge occurring after the last sustain discharge pulse falls and to thus improve the drive voltage margin.

Although the above-mentioned fourth embodiment of the present invention is applied to the high-contrast driving method, the concept thereof is not limited thereto. For example, the same effects as described above can be obtained in a case where the whole screen write discharge and the erase discharge using the narrow-width pulse are caused during the reset periods of all the subfields. Further, the fourth embodiment will be effective to another case where only the erase discharge using the narrow-width pulse is caused without the whole screen write discharge during the reset periods of all the subfields.

Figure 13:
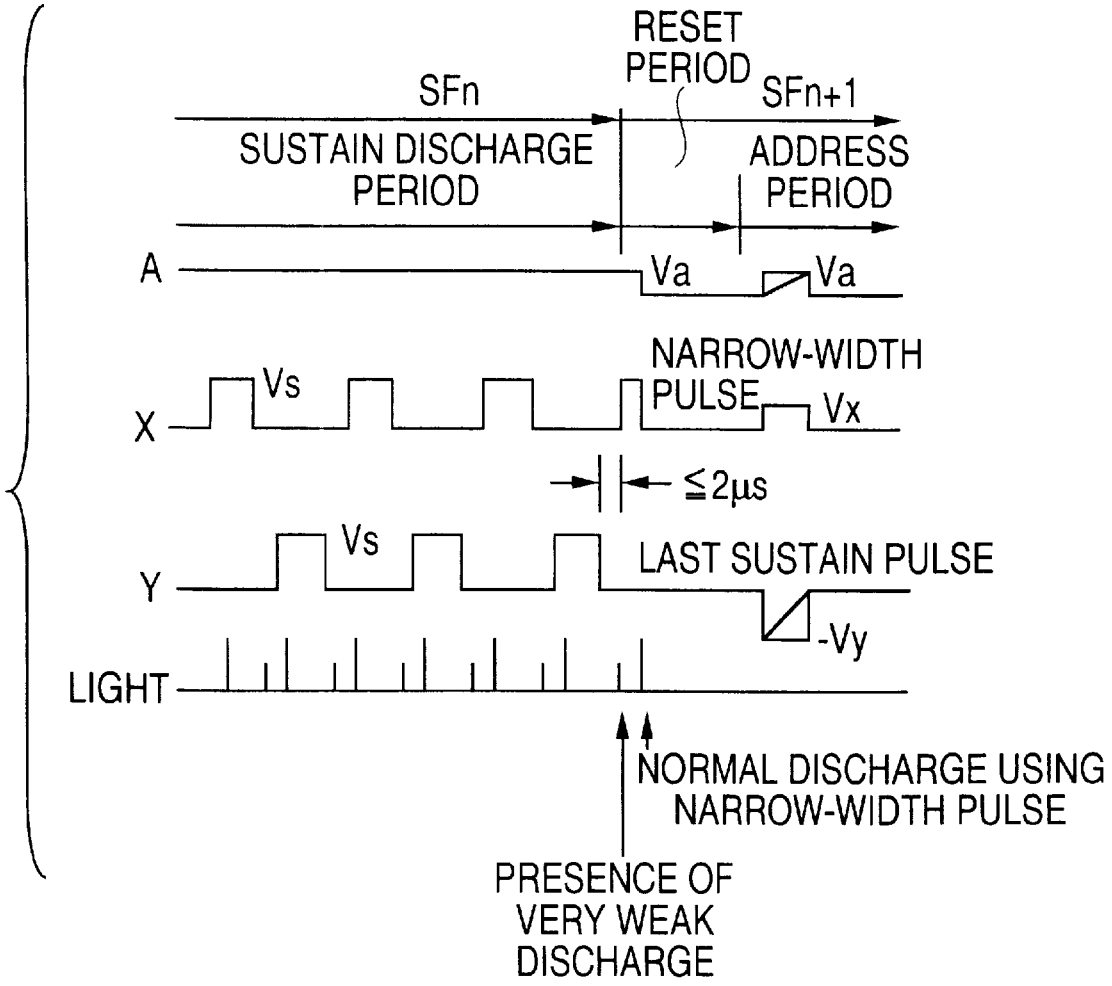
FIG. 13 is a waveform diagram of drive pulses according to a fifth embodiment of the present invention.

FIG. 13 is a waveform diagram of drive pulses according to a fifth embodiment of the present invention, which is exemplarily applied to the high-contrast driving method. More particularly, in the subfield SFn+1, the whole screen write discharge is not caused, but the erase pulse which is the narrow-width pulse is applied to the X electrodes in order to erase the wall charges. The fifth embodiment has an arrangement in which the interval between the last sustain discharge pulse and the narrow-width pulse applied with the reset period of the subsequent subfield in which the whole screen discharge is not caused is as narrow as the interval between the sustain discharge pulses within the sustain discharge period of the same subfield.

Figure 1:
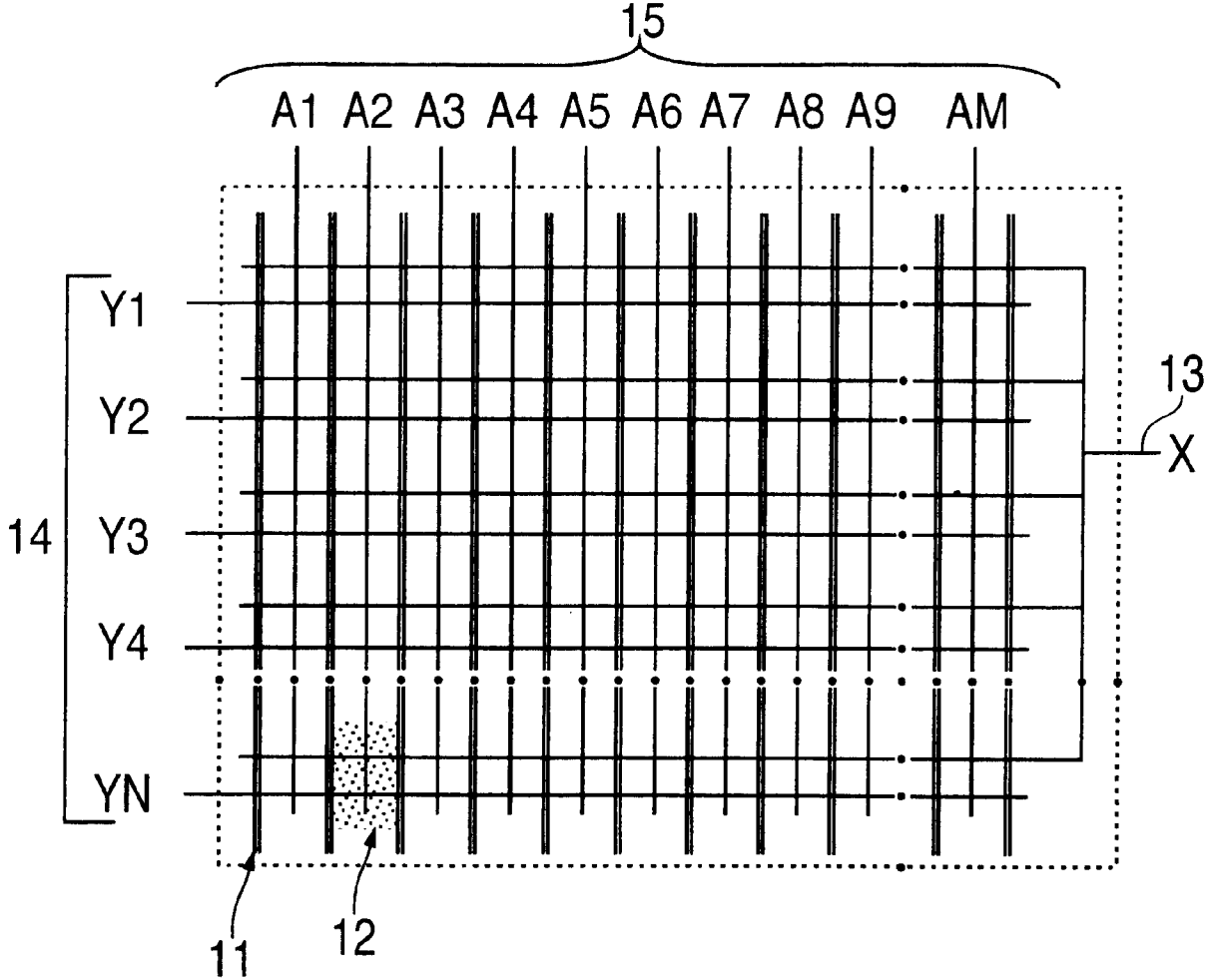
FIG. 1 is a schematic plan view of a triple-electrode surface discharge AC type plasma display panel.
Figure 2:
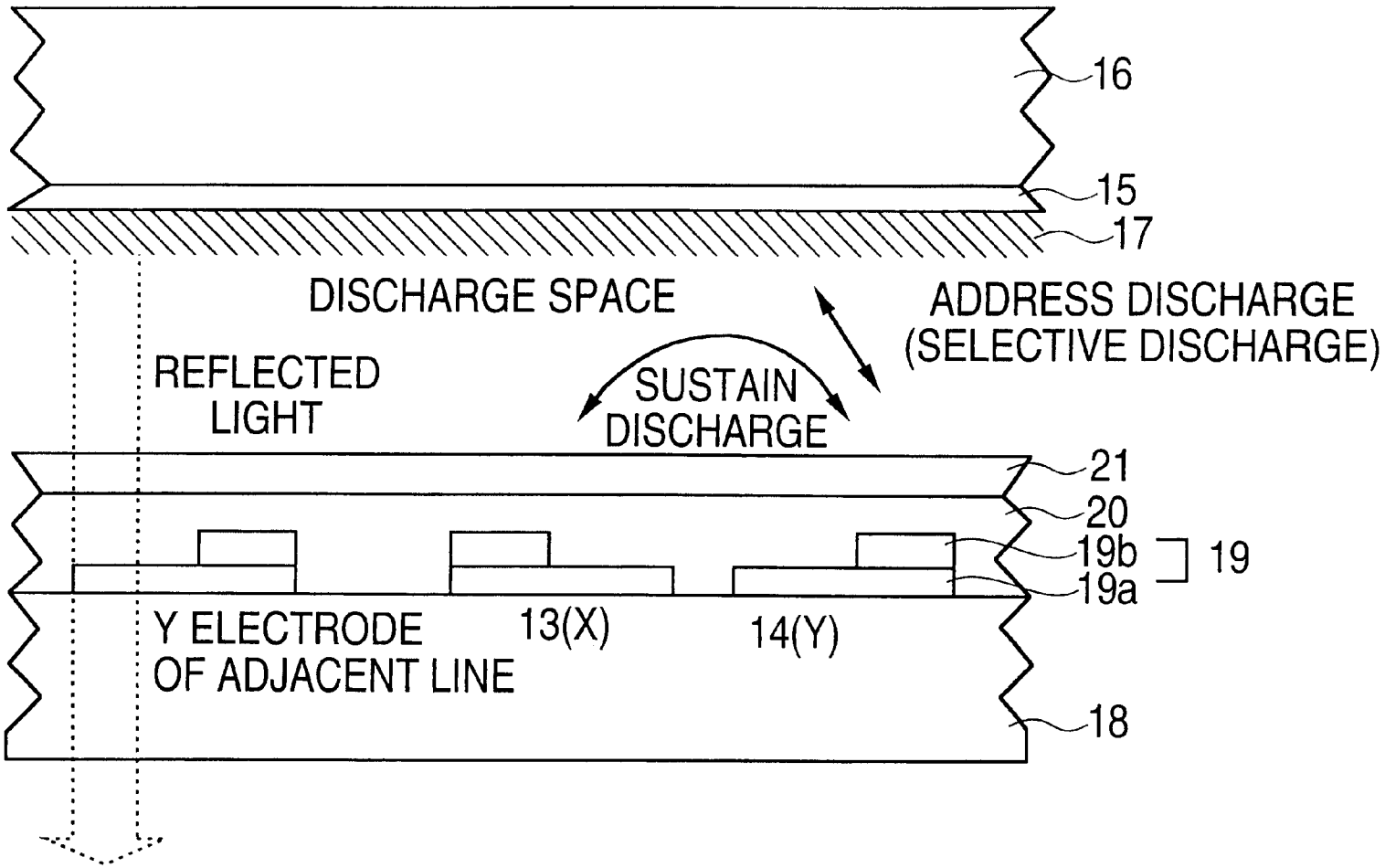
FIG. 2 shows a section of the triple-electrode surface discharge AC type plasma display panel in the vertical direction.
Figure 3:
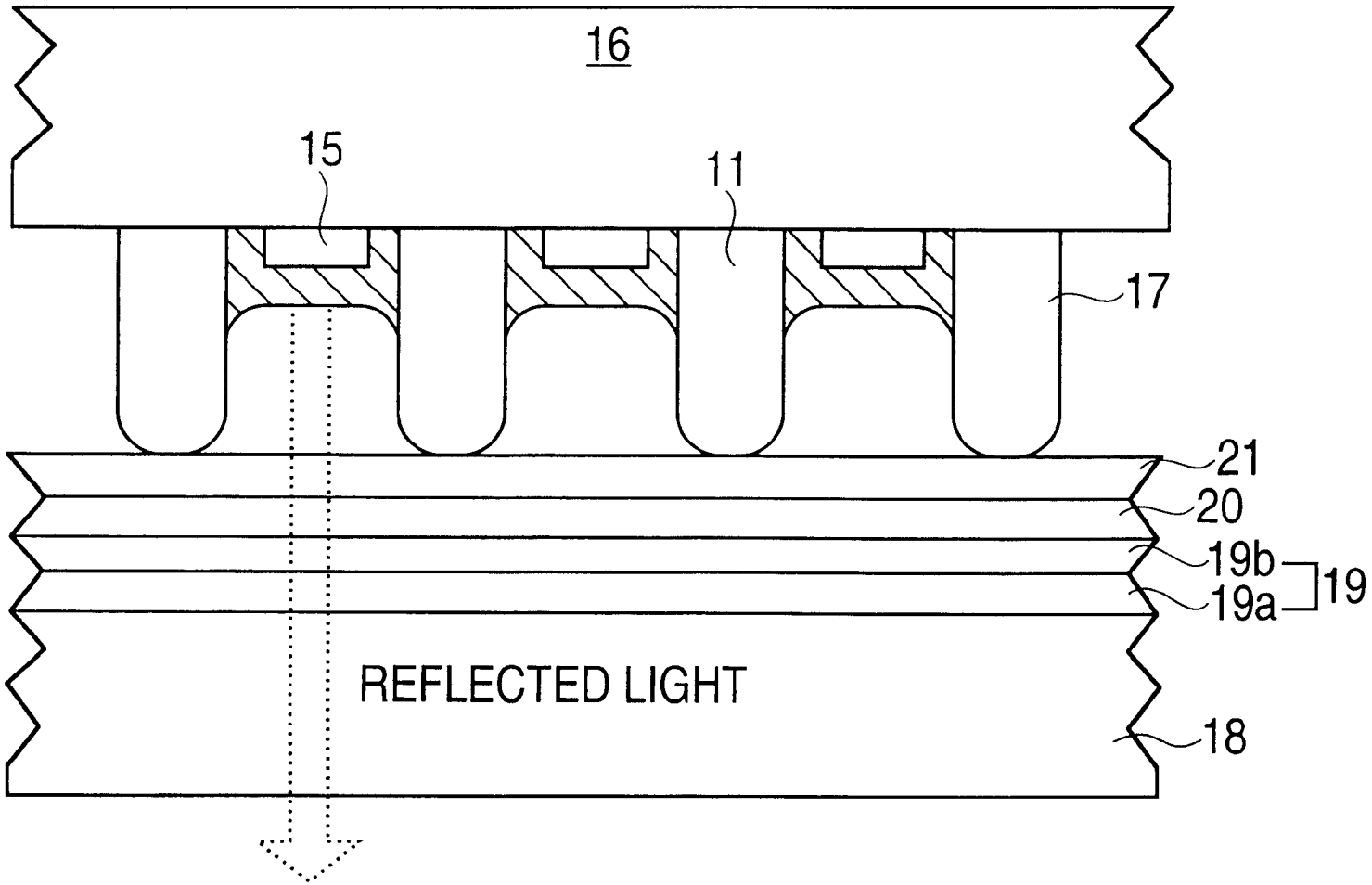
FIG. 3 shows a section of the triple-electrode surface discharge AC type plasma display panel in the horizontal direction.
Figure 4:
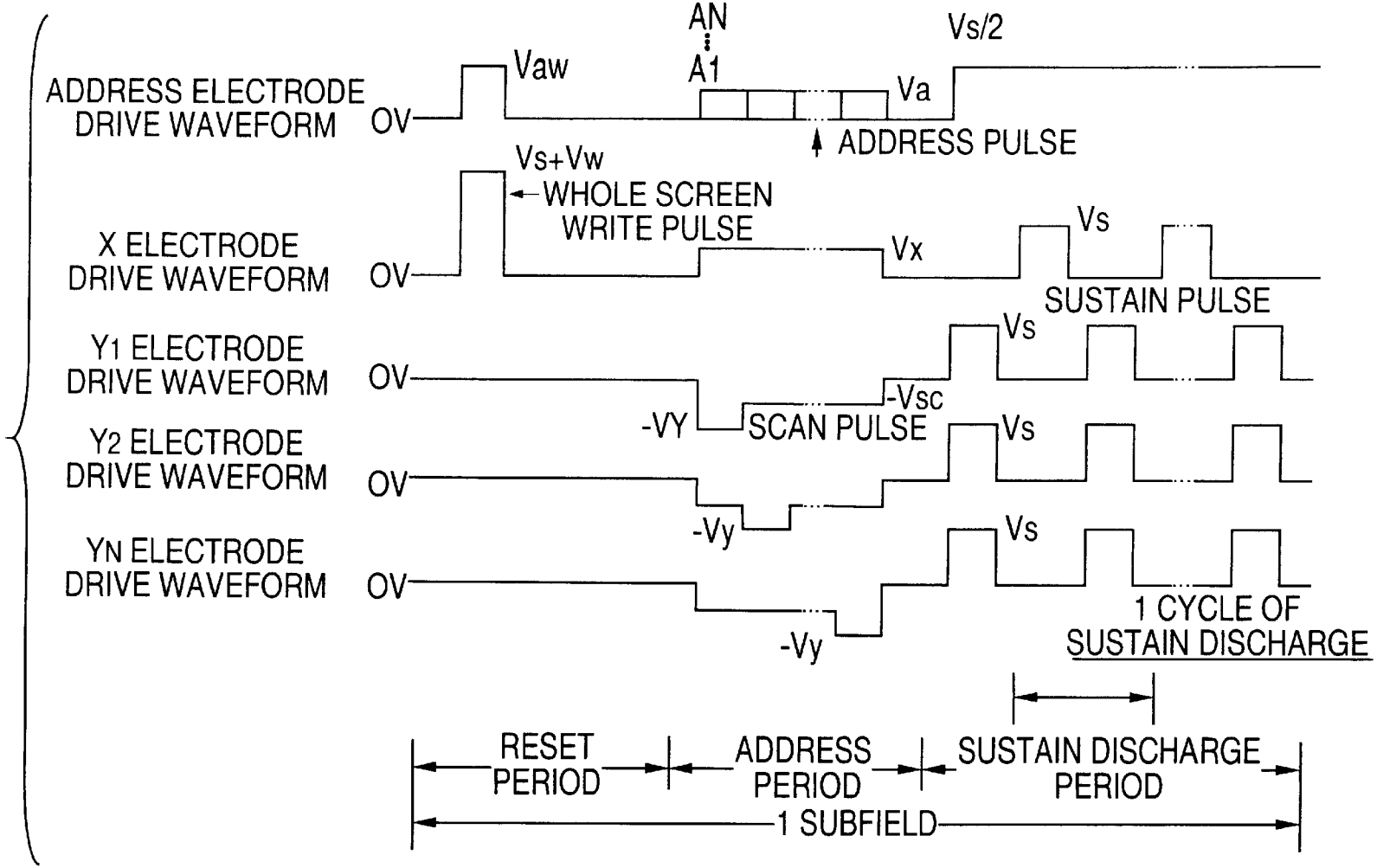
FIG. 4 is a waveform diagram showing a conventional driving method.
Figure 5:
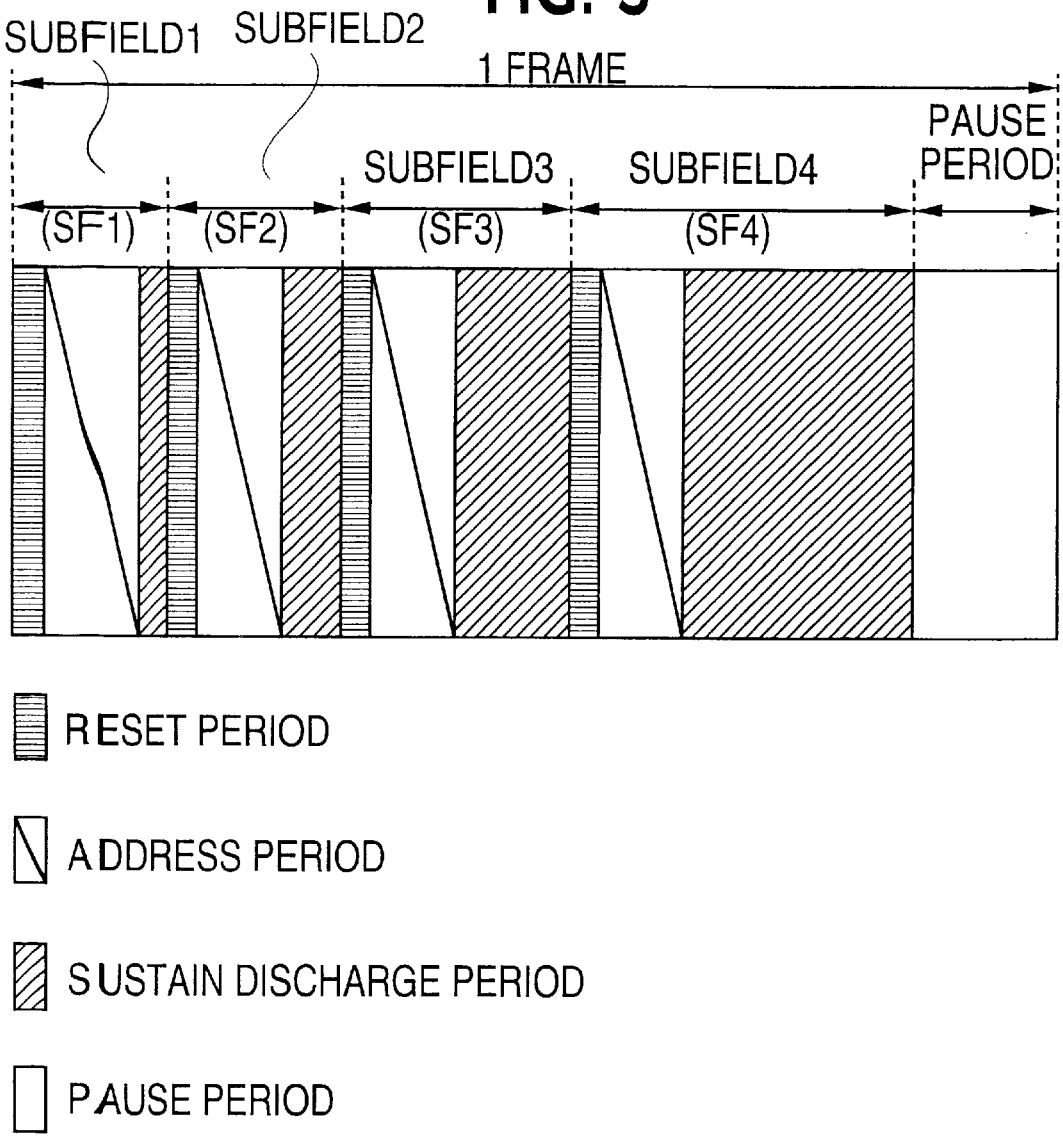
FIG. 5 is a time chart of an address discharge/sustain discharge separation type write address system.
Figure 6:
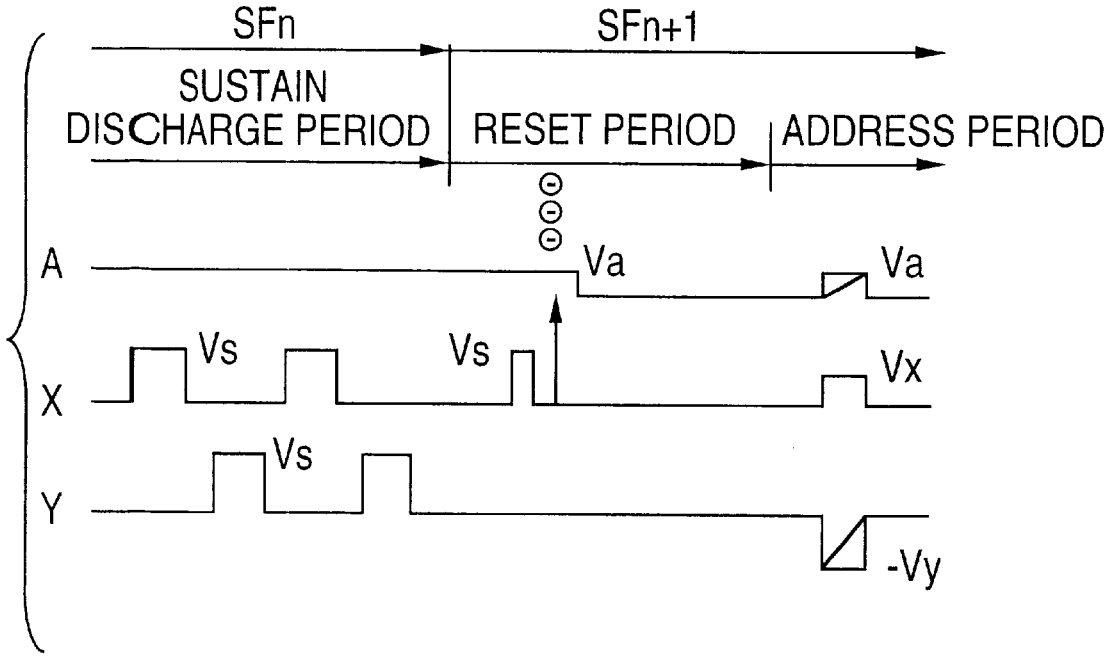
FIG. 6 is a diagram showing residual wall charges.
Figure 7:
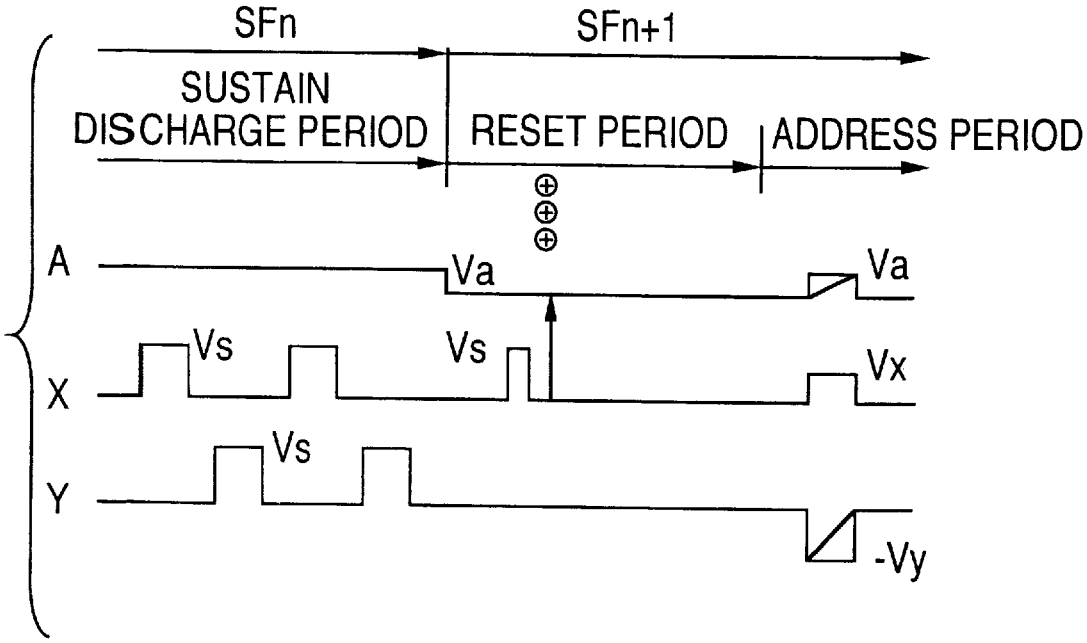
FIG. 7 is another diagram showing residual wall charges.
Figure 8:
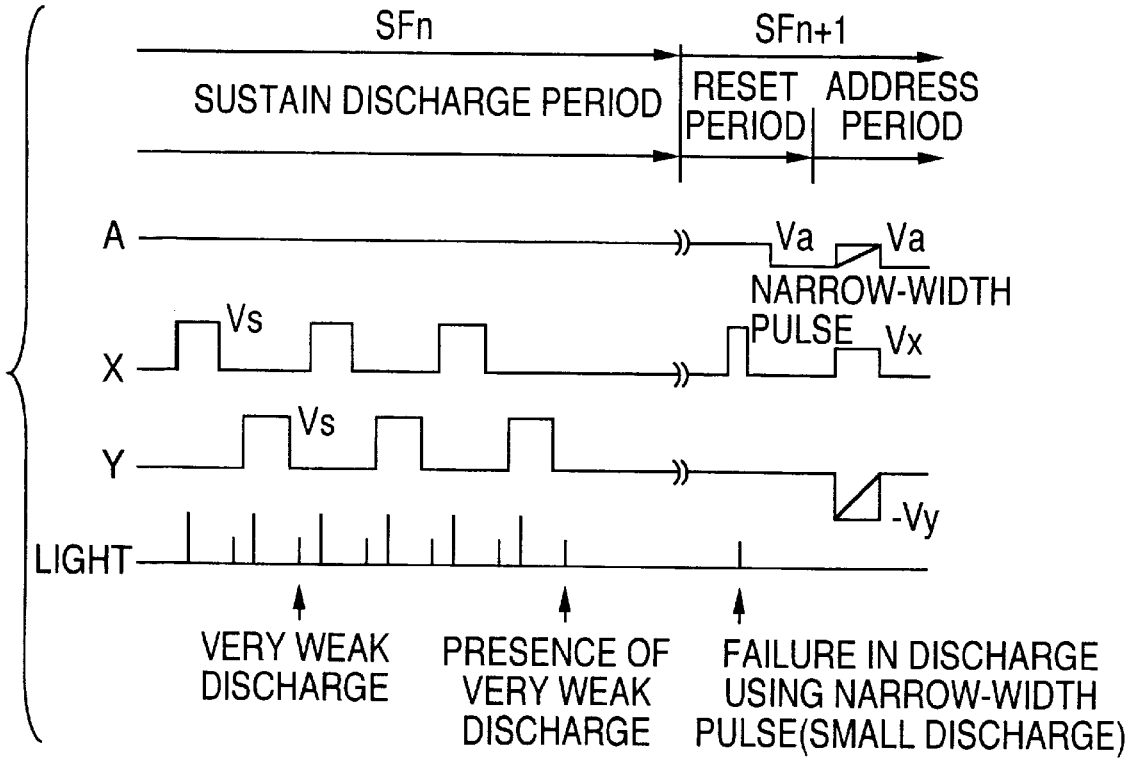
FIG. 8 is a diagram showing an influence of a very discharge.

As has been described with reference to FIG. 8, the very weak discharge which occurs after the last sustain discharge pulse falls affects the subsequent erase discharge. However, the very weak discharge hardly affects the sustain discharge pulses successively applied. It appears that the reason why the very weak discharge does not affect the sustain discharge is that the next pulse is applied immediately after the very weak discharge occurs.

The fifth embodiment of the present invention is made taking into consideration the above, the interval between the last sustain discharge pulse and the narrow-width pulse applied in the reset period of the subsequent subfield in which the whole screen discharge is not caused is as narrow as the interval between the sustain discharge pulses within the sustain discharge period of the same subfield. Preferably, the above interval is equal to or less than 2 $\mu$s.

As shown in FIG. 13, although the very weak discharge takes place after the last sustain discharge pulse falls, the discharge using the narrow-width pulse occurs normally. Hence, the drive voltage margin can be improved.

Although the fifth embodiment of the present invention is applied to the high-contrast driving method, the concept thereof is not limited thereto. For example, the same effects as described above can be obtained in a case where the whole screen write discharge is caused during the reset periods of all the subfields. In this case, the interval between the last sustain discharge pulse and the whole screen write pulse within the reset period in the subsequent subfield is set as narrow as the interval between the sustain discharge pulses. Further, the fifth embodiment will be effective to another case where only the erase discharge using the narrow-width pulse is caused without the whole screen write discharge during the reset periods of all the subfields.

Figure 14:
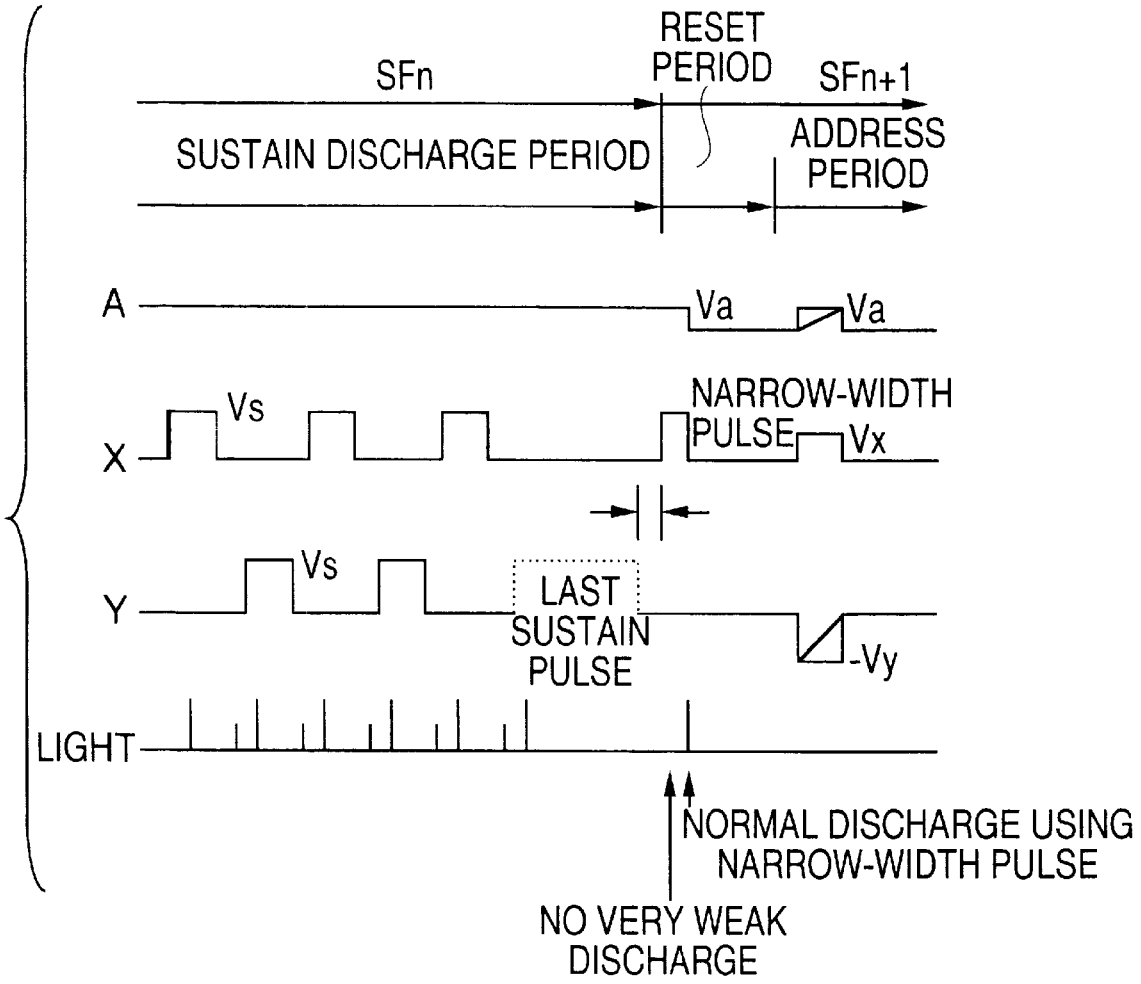
FIG. 14 is a waveform diagram of drive pulses according to a sixth embodiment of the present invention.

FIG. 14 is a waveform diagram of drive voltages according to a sixth embodiment of the present invention, which corresponds to the combination of the aforementioned fourth and fifth embodiments. More particularly, the sixth embodiment has an arrangement in which the pulse width of the last sustain discharge pulse is set longer than the pulse widths of the remaining sustain discharge pulses. In addition, the interval between the last sustain discharge pulse and the narrow-width pulse applied within the reset period of the subsequent subfield in which the whole screen discharge is not caused is as narrow as the interval between the sustain discharge pulses within the sustain discharge period.

The sixth embodiment of the present invention includes the concept of the fourth embodiment, and thus the very weak discharge does not occur after the last sustain discharge pulse falls. Even if the very weak discharge occurs, the erasing using the narrow-width pulse can duly be caused because the sixth embodiment includes the concept of the fifth embodiment. Hence, the sixth embodiment can more completely cause the erase discharge.

According to the sixth embodiment of the present invention, it is possible to prevent occurrence a failure in erasing during the reset period resulting from the very weak discharge caused after the last sustain discharge pulse and to thus improve the drive voltage margin. Further, the sixth embodiment is not limited to the high-contrast driving method but may be applied to cases as described before.

Figure 15:
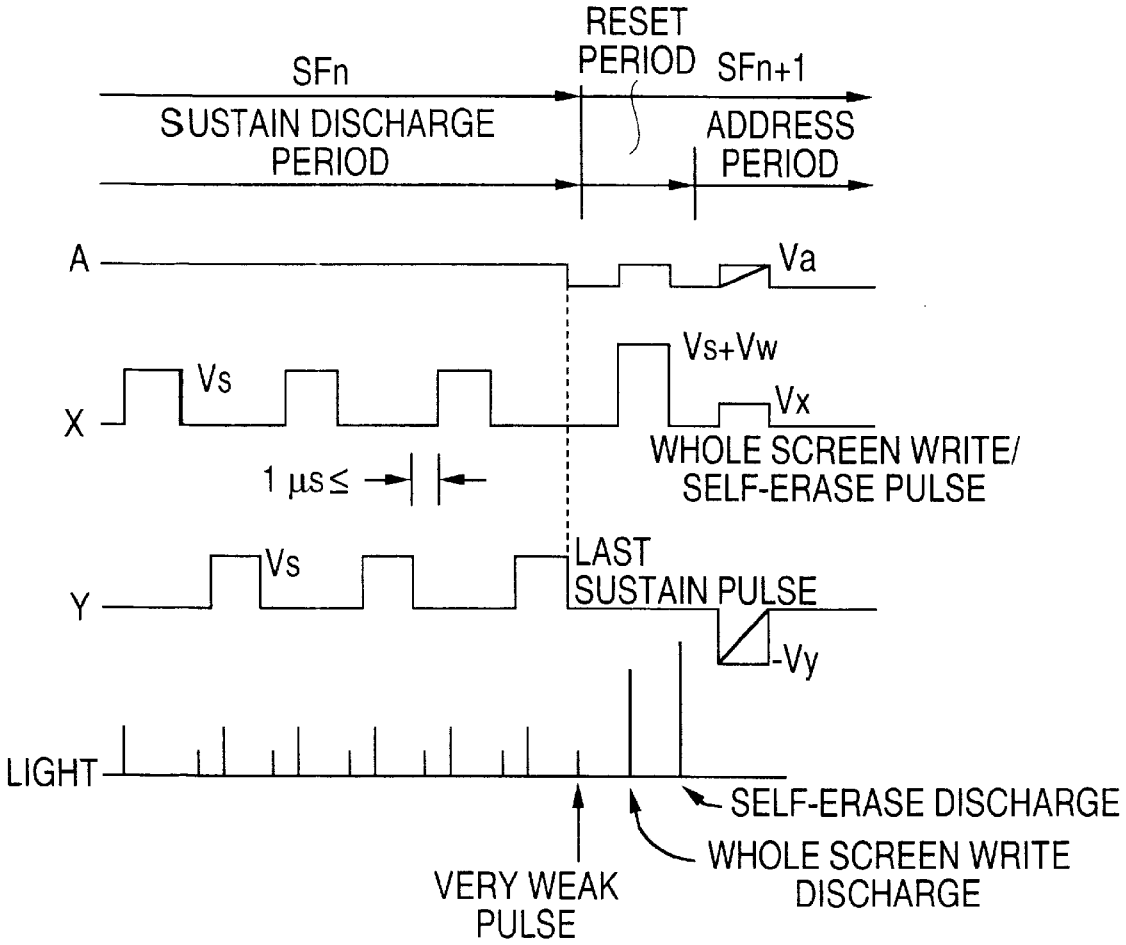
FIG. 15 is a waveform diagram of drive pulses according to a seventh embodiment of the present invention.

FIG. 15 is a waveform diagram of drive pulses according to a seventh embodiment of the present invention, in which the whole screen write pulse causing the self-erase is applied to the X electrodes within the subfield SFn+1 in order to erase the wall charges.

The seventh embodiment has an arrangement in which the fall of the last sustain discharge pulse and the fall of the potential Va of the address electrodes occur concurrently, so that the wall charges on the address electrodes are equalized. The inventors have confirmed that the interval between the sustain discharge pulses within the sustain discharge period is preferably set equal to or less than 1 $\mu$s in order to reduce the wall charges on the address electrodes.

According to the seventh embodiment of the present invention, it is possible to equalize the wall charges on the address electrodes and to thus prevent occurrence of a failure in erasing during the reset period and improve the drive voltage margin. The seventh embodiment is not limited to the driving method shown in FIG. 15 but may be applied to the high-contrast driving method.

Figure 16:
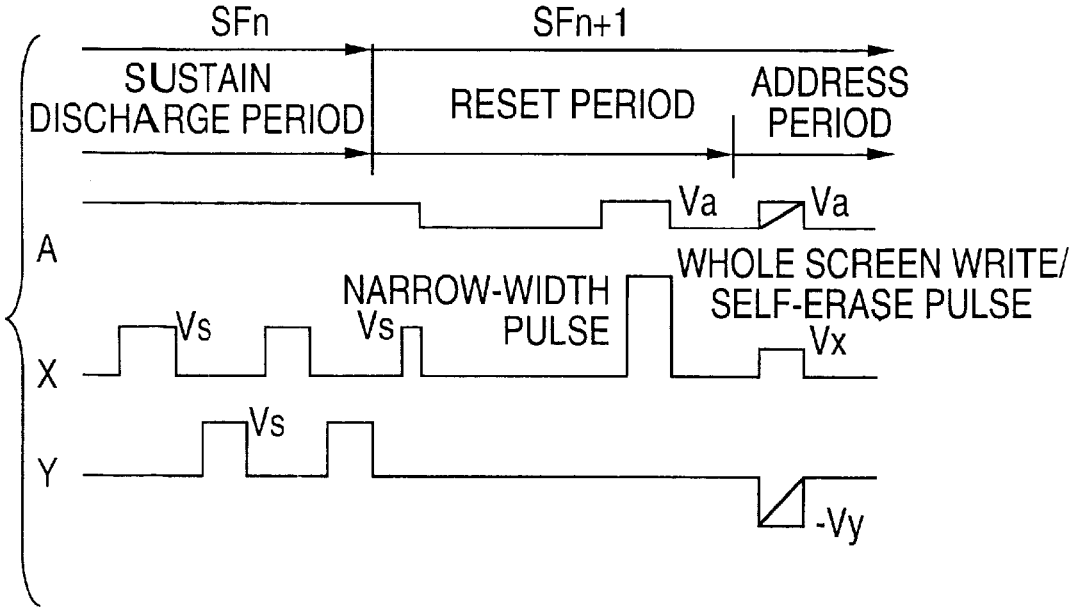
FIG. 16 is a waveform diagram of drive pulses according to an eighth embodiment of the present invention.
Figure 17:
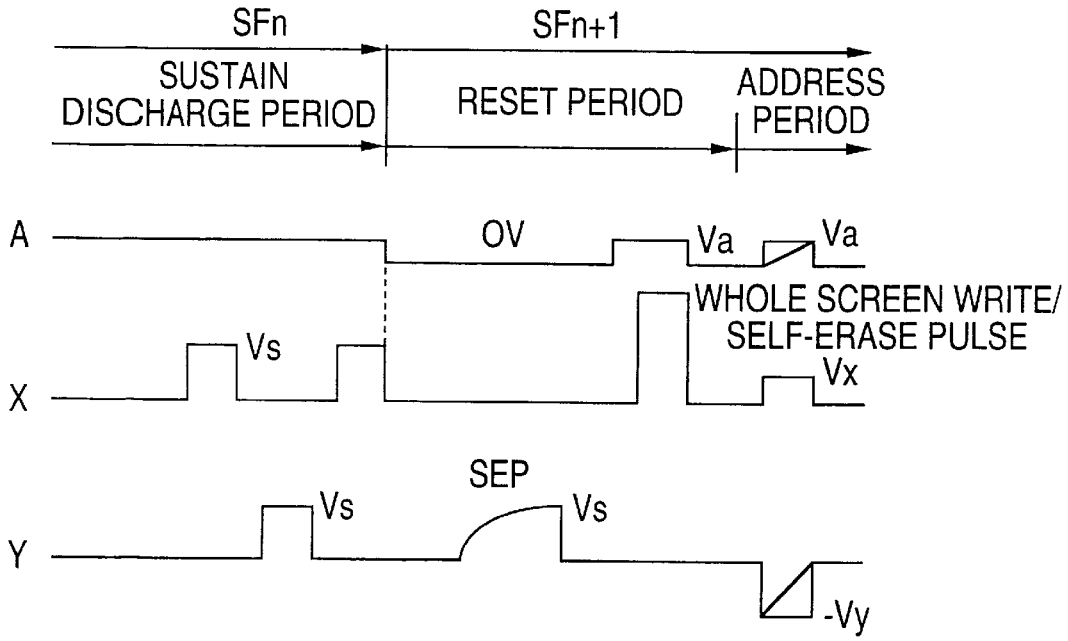
FIG. 17 is a waveform diagram of drive pulses according to a ninth embodiment of the present invention.
Figure 18:
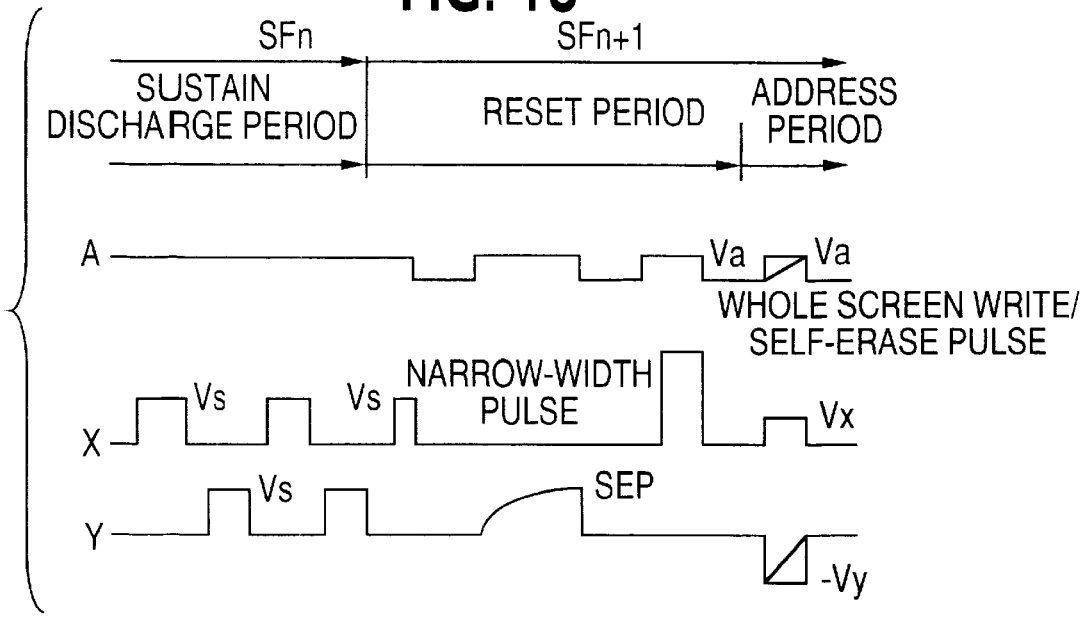
FIG. 18 is a waveform diagram of drive pulses according to a tenth embodiment of the present invention.

FIGS. 16, 17 and 18 are respectively waveform diagrams of drive pulses according to eighth, ninth and tenth embodiments of the present invention, which are applied to the high-contrast driving method. The eighth to tenth embodiments of the present invention have an arrangement in which a pulse or pulses having the erasing function, such as the narrow-width pulse, the slope erase pulse or both are applied to the electrodes immediately before the subfield in which the whole screen discharge should se caused. The use of the pulse or pulses contributes to reducing the load on the whole screen discharge. Hence it is possible to always obtain an identical state of the residual wall charges before the whole screen write discharge is caused irrespective of the lighting state in the immediately previous subfield. Hence, it is possible to more completely erase the residual wall charges on the address electrodes.

As shown in FIG. 16, according to the eight embodiment of the present invention, the erase pulses within the reset period in the subfield SFn+1 is the whole screen write pulse causing the self-erase. The narrow-width pulse is disposed after the sustain discharge period in the immediately previous subfield SFn.

As shown in FIG. 17, according to the ninth embodiment of the present invention, the erase pulse within the reset period in the subfield SFn+1 is the whole screen write pulse causing the self-erase. The slope erase pulse SEP are disposed after the sustain discharge period in the immediately previous subfield SFn.

As shown in FIG. 18, according to the tenth embodiment of the present invention, the erase pulses within the reset period in the subfield SFn+1 are the whole screen write pulse causing the self-erase. The narrow-width pulse and the slope erase pulse SEP are disposed after the sustain discharge period in the immediately previous subfield SFn.

By using the above-mentioned pulses, it is possible to obtain an identical state of residual wall charges before the whole screen write discharge irrespective of the lighting state in the immediately previous subfield.

According to the eighth, ninth and tenth embodiments of the present invention, it is possible to more completely erase the residual wall charges on the address electrodes and to thus improve the drive voltage margin.

Although the above-mentioned eighth to tenth embodiments of present invention are applied to the high-contrast driving methods, the concept thereof is not limited to the high-contrast driving method. For example, the same effects as described above can be obtained in a case where the whole screen write discharge is caused during the reset periods of all the subfields.

Figure 19:
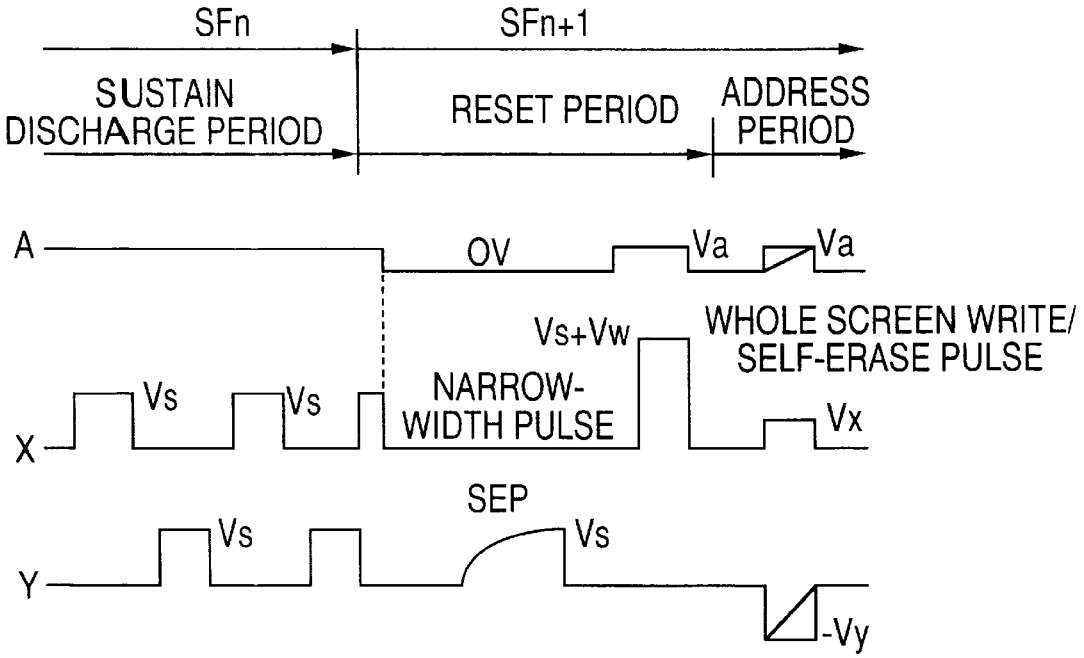
FIG. 19 is a waveform diagram of drive pulses according to an eleventh embodiment of the present invention.

FIG. 19 is a waveform diagram of drive pulses according to an eleventh embodiment of the present invention, which is exemplarily applied to the high-contrast driving method. In the present embodiment, a further erase discharge is caused before the whole screen write discharge is caused, and the voltage to be applied to the address electrodes at that time is set equal to 0 V. By setting the voltage applied to the address electrodes at the time of erasing to 0 V, it is possible to always obtain an identical state of the residual wall charges before the whole screen write discharge is caused and to thus erase the residual wall charges on the address electrodes more completely. Hence, the drive voltage margin can be improved.

Although the above-mentioned eleventh embodiment of the present invention is applied to the high-contrast driving method, the concept thereof is not limited to the high-contrast driving method. For example, the same effects as described above can be obtained in a case where the whole screen write discharge is caused during the reset periods of all the subfields.

Figure 20:
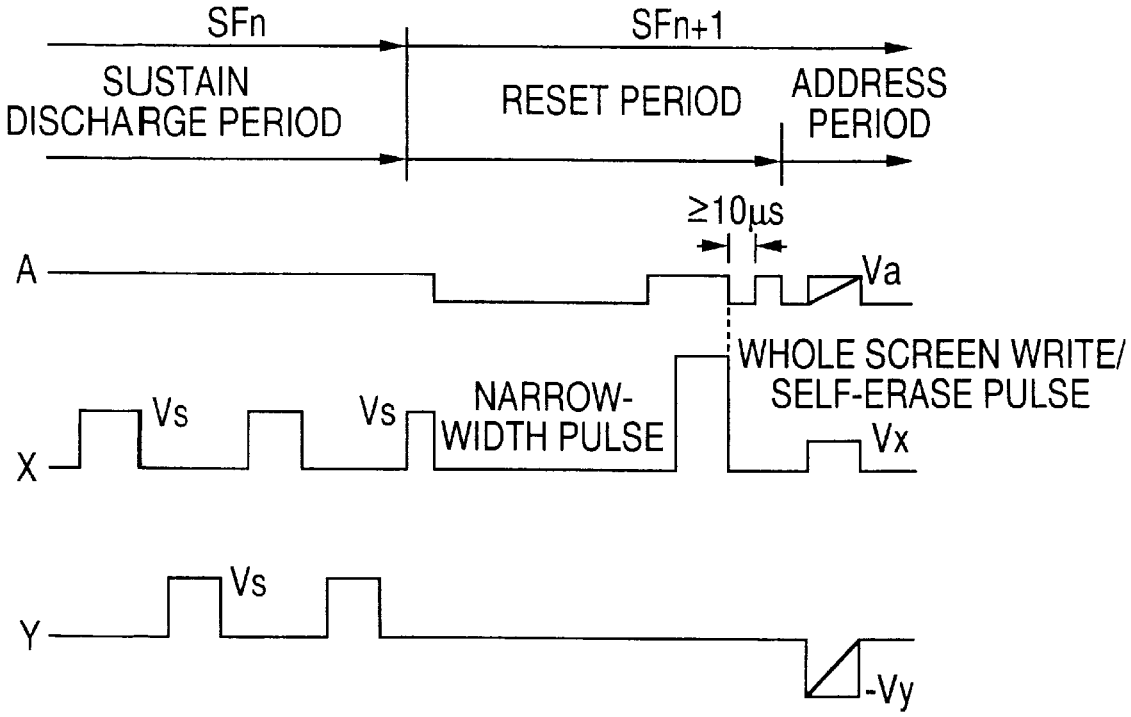
FIG. 20 is a waveform diagram of drive pulses according to a twelfth embodiment of the present invention.

FIG. 20 is a waveform diagram of drive pulses according to an twelfth embodiment of the present invention, which as exemplarily applied to the high-contrast driving method. In the present embodiment, a further erase discharge is caused before the whole screen write discharge is caused. After the hole screen write pulse falls, the narrow-width pulse is applied to the address electrodes. Hence, even if well charges remain after the whole screen write discharge, the residual wall charges on the address electrodes can be erased more completely.

The experiments conducted by the inventors show that the interval between the falling edge of the whole screen write pulse and the rising edge of the narrow-width pulse applied to the address electrodes is preferably equal so or less than 10 $\mu$s.

According to the twelfth embodiment of the present invention, it is possible to more completely erase the wall electrodes on the address electrodes by the whole screen write pulse causing the self-erase and to thus improve the drive voltage margin. Further, the twelfth embodiment is not limited to the high-contrast driving method.

Figure 21:
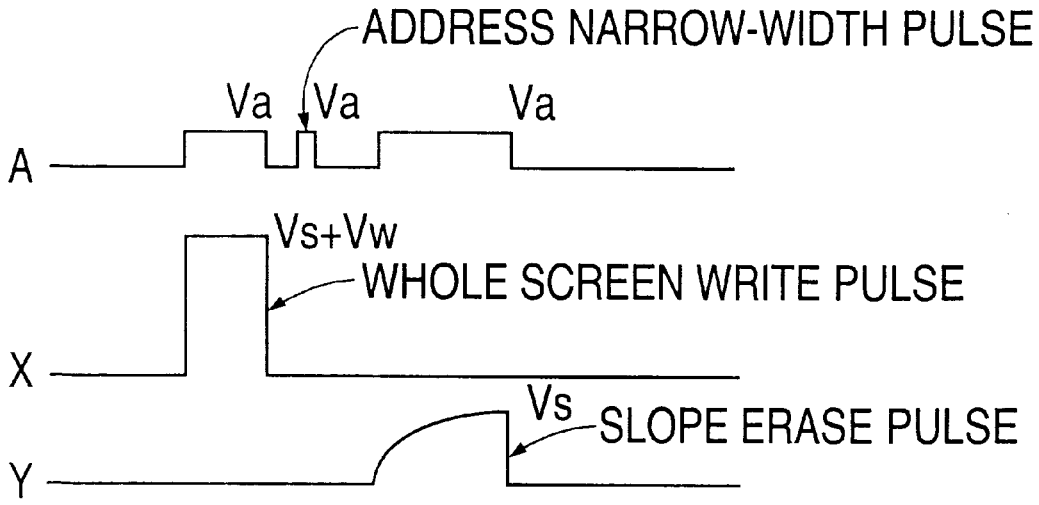
FIG. 21 is a waveform diagram of drive pulses according to a thirteenth embodiment of the present invention.

FIG. 21 is a waveform diagram of drive pulses according to a thirteenth embodiment of the present invention, and particularly shows only part of the reset period. The present embodiment has a reset period within which an address narrow-width pulse is applied to the address electrodes, and the narrow-width pulse which continuously changes the applied voltage is applied to the address electrodes after the whole screen write pulse falls. Hence, even if there are residual wall charges after the whole screen write discharge, the combination of the address narrow-width pulse and the slope erase pulse further erases the remaining wall charges on the address electrodes.

According to the thirteenth embodiment of the present invention, it is possible to more completely erase the wall charges on the address electrodes by using the whole screen write pulse causing the self-erase, which is applied within the reset period and to thus improve the drive voltage margin. The thirteenth embodiment is not limited to the high-contrast drive method as in the case of the aforementioned embodiments.

Figure 22A:
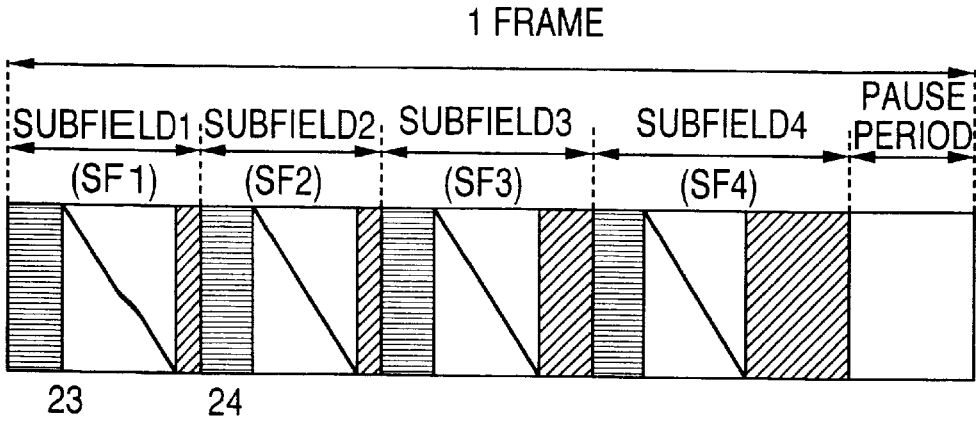
FIGS. 22A, 22B and 22C are respectively waveform diagrams of drive pulses according to a fourteenth embodiment of the present invention.
Figure 22B:
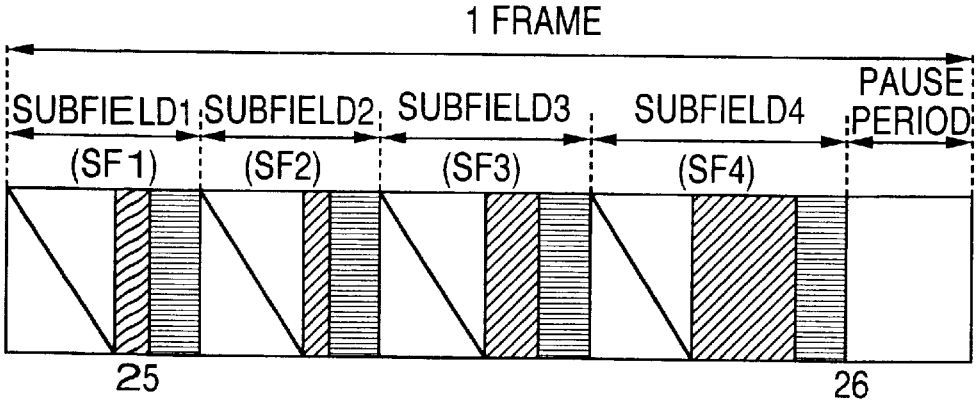
Figure 22C:
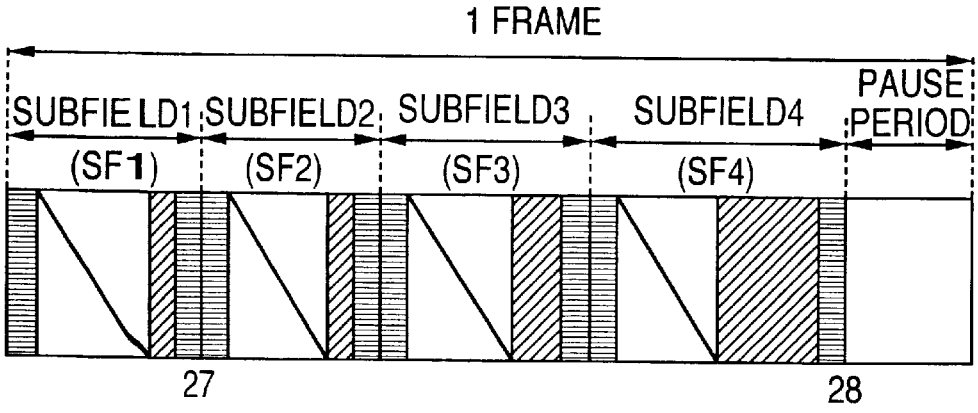

FIGS. 22A, 22B and 22C are respectively diagrams of a weighted arrangement of drive pulses according to a fourteenth embodiment of the present invention, in which the total number of subfields which are weighted is 4. More particularly, FIG. 22A shows a case where the reset period, the address period and the sustain discharge period are arranged in this order in each of the subfields. FIG. 22B shows a case where the address period, the sustain discharge period and the reset period are arranged in this order in each of the subfields. FIG. 22C shows a case where the reset period (including the whole screen write pulse), the address period, the sustain discharge period and another reset period (which does not include the whole screen write pulse) in this order in each of the subfields.

In the fourteenth embodiment of the present invention, the reset periods, within which the whole screen write pulse causing the self-erase is applied, are disposed after the sustain discharge period which is the shortest or longest period.

For example, when the reset periods are disposed after the shortest sustain discharge periods, these reset periods correspond to a reset period 24 in the subfield 2 (SF2) shown in FIG. 22A, a reset period 25 in the subfield 1 (SF1) shown in FIG. 22B, and a reset period 27 located in the trailing end of the subfield 1 (SF1) shown in FIG. 22C.

When the number of subfields in which the whole screen write discharge is caused is decreased, an increased number of residual wall charges is accumulated on the address electrodes, and the load on the reduced number of subfields is increased. The residual wall charges are accumulated during the sustain discharge period. Hence, in order to reduce the load on the whole screen write discharge, the sustain discharge period in the immediately previous subfield is preferably shorter.

When the reset periods, within the whole screen write pulse causing the self-erase is applied, are disposed after the longest sustain discharge periods, these reset periods correspond to a reset period 23 in the subfield 1 (SF1) shown in FIG. 22A, a reset period 26 in the subfield 4 (SF4) shown in FIG. 22B, and a reset period 28 located in the trailing end of the subfield 4 (SF4) shown in FIG. 22C.

When the number of subfields in which the whole screen write discharge is caused is decreased, an increased number of residual wall charges is accumulated on the address electrodes, and the load on the reduced number of subfields is increased. The residual wall charges are accumulated during the sustain discharge period. Hence, in order to increase the effect of the whole screen write discharge, the sustain discharge period in the immediately previous subfield is preferably longer.

According to the fourteenth embodiment of the present invention, it is possible to minimize the influence of the residual wall charges accumulated on the address electrodes during the sustain discharge period and to thus erase the wall charges more completely. Thus, the drive voltage margin can be improved.

Figure 23:
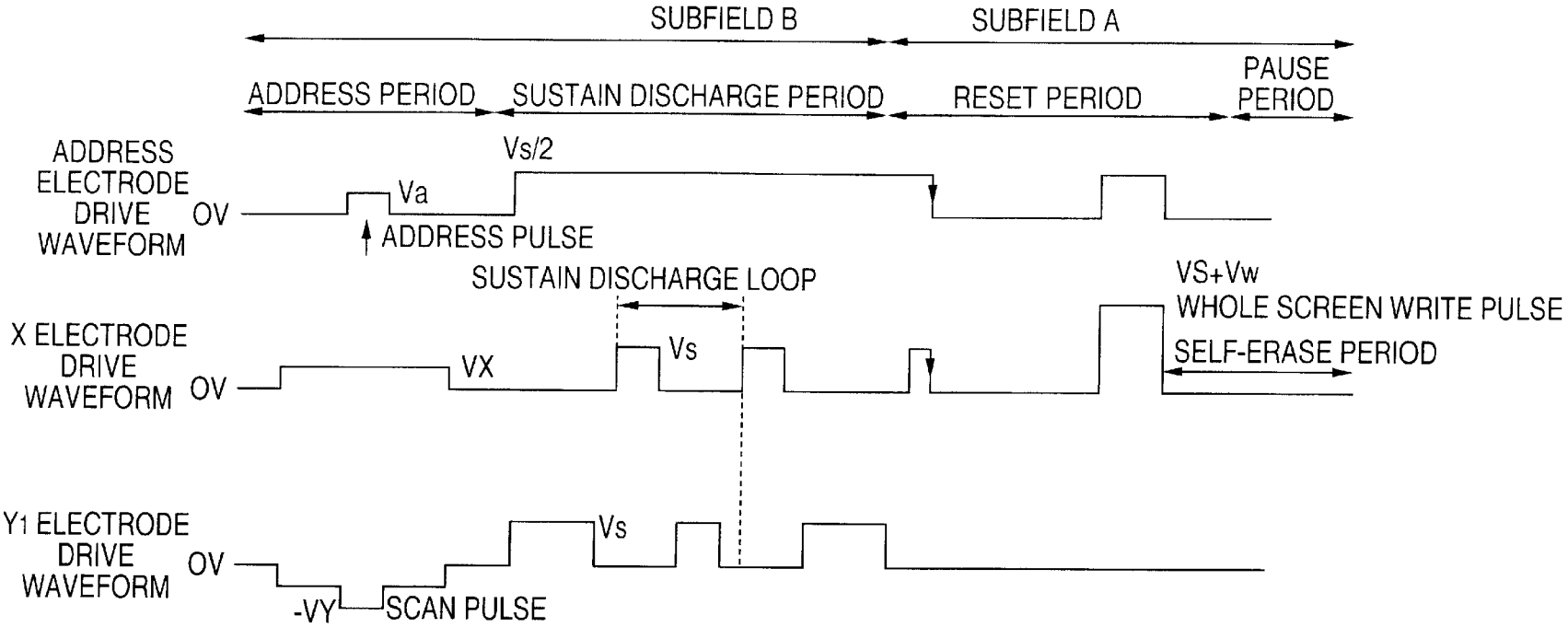
FIG. 23 is a waveform diagram of drive pulses according to a fifteenth embodiment of the present invention.

FIG. 23 is a waveform diagram of drive voltages according to a fifteenth embodiment of the present invention, which is exemplarily applied to the high-contrast driving method. Within a subfield A, a pulse having the erasing function is applied immediately prior to the subfield in which the whole screen write discharge is caused, as in the case shown in FIG. 16.

According to the fifteenth embodiment, a pause period during which no drive pulses are output is used as the self-erasing period to be arranged after the whole screen write pulse is applied. Further, the pause period is disposed in the subfield A in which both the whole screen write discharge and the erasing discharge are caused. The pause period thus arranged contributes to stabilizing the number of wall charges to be reset and thus performing the erase discharge more completely.

FIGS. 24 and 25 respectively waveform diagrams of drive pulses according to sixteenth and seventeenth embodiments of the present invention, which are exemplarily applied to the high-contrast driving method. More particularly, FIGS. 24 and 25 show only parts of the respective reset periods. The sixteenth and seventeenth embodiments utilize combinations of a plurality of erase pulses to be applied within the reset period in order to more certainly erase the residual wall discharges.

Figure 24A:
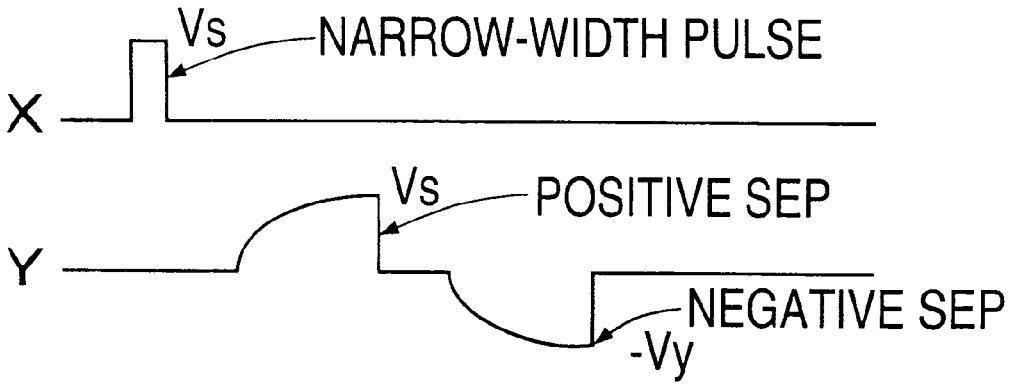
FIG. 24 is a waveform diagram of drive pulses according to a sixteenth embodiment of the present invention.
Figure 24B:
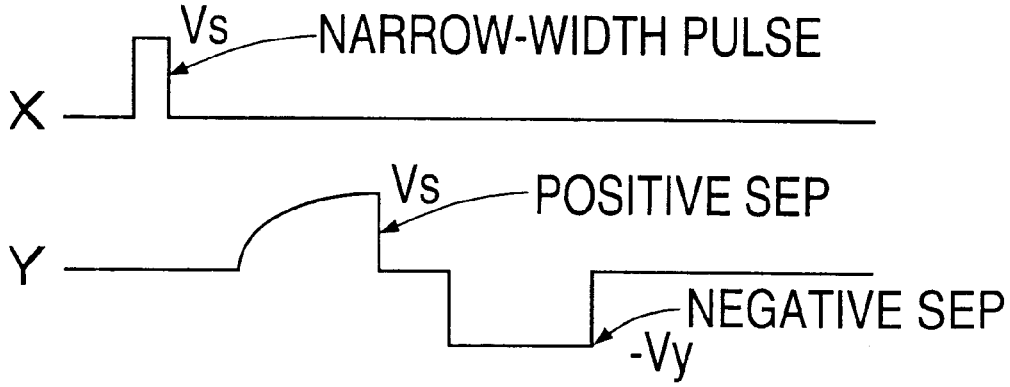

Within the reset period shown in FIG. 24(A), the narrow-width pulse is applied to the X electrodes, and then a slope erase pulse which changes in the positive direction (positive pulse) is applied to the Y electrodes. Thereafter, another slope erase pulse which changes in the negative direction (negative pulse) is applied to the Y electrodes. Within the reset period shown in FIG. 24(B), the narrow-width pulse is applied to the X electrodes, and then a slope erase pulse which changes in the positive direction is applied to the Y electrodes. Thereafter, a rectangular-shaped pulse having a minus voltage is applied to the Y electrodes.

Figure 25A:
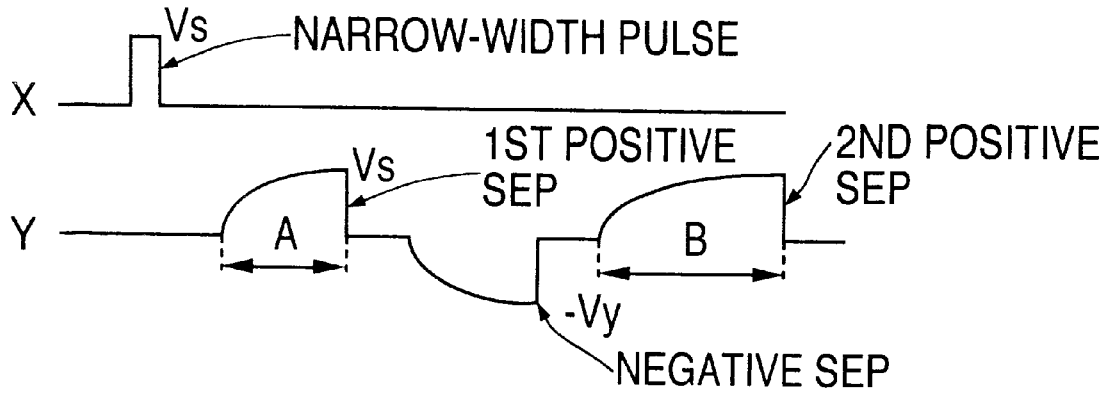
FIG. 25 is a waveform diagram of drive pulses according to a seventeenth embodiment of the present invention.
Figure 25B:
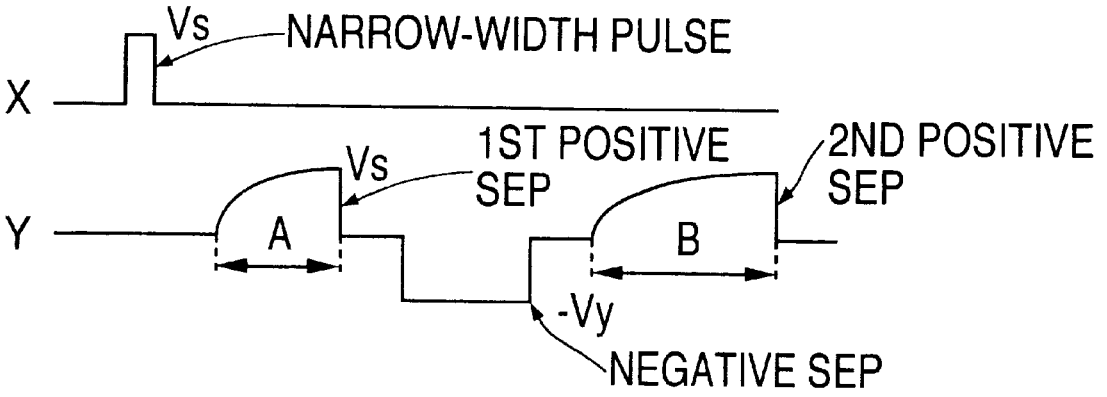

Within the reset period shown in FIG. 25(A), a fourth erase pulse is added to the arrangement shown in FIG. 24(A). The fourth erase pulse serves as the second positive slope erase pulse. Within the reset period shown in FIG. 25(B), a fourth erase pulse is added to the arrangement shown in FIG. 24(B). The fourth erase pulse serves as the second positive slope erase pulse.

The experiments conducted by the inventors show that the second positive slope erase pulse (the fourth erase pulse) preferably has a width B longer than the width A of the first positive slope erase pulse (the second erase pulse). It has been confirmed that the above with relationship provides the more excellent effects. In general, it is preferable that the n+1th positive slope erase pulse has a width longer than that of the nth positive slope erase pulse.

The combinations of the erasing pulses defined according to the sixteenth and seventeenth embodiments contribute to resetting the residual wall charges more certainly before the address selective discharge is carried out. Hence, the drive voltage margin can be improved.

Figure 26:
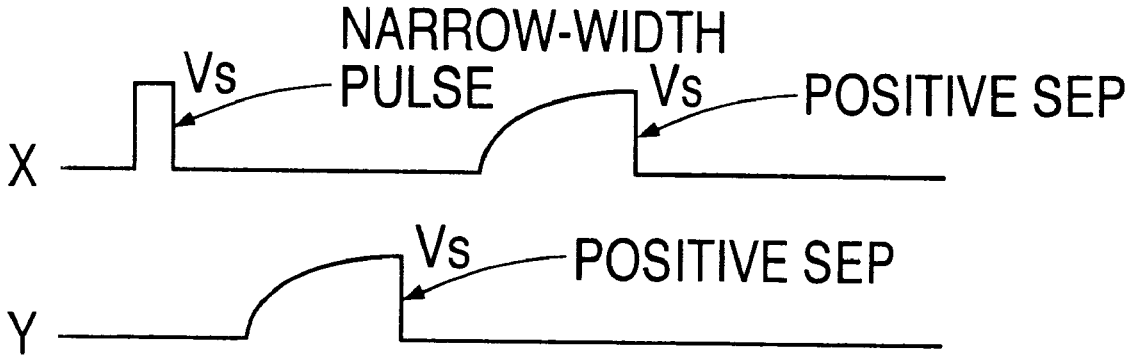
FIG. 26 is a waveform diagram of drive pulses according to an eighteenth embodiment of the present invention.

FIG. 26 is a waveform diagram of drive pulses according to an eighteenth embodiment of the present invention, which is exemplarily applied to the high-contrast driving method. More particularly, FIG. 26 shows a part of the reset period. The eighteenth embodiment also utilizes combinations of a plurality of erase pulses to be applied within the reset period in order to more certainly erase the residual wall discharges.

Referring to FIG. 26, the narrow-width pulse is applied to the X electrodes, and then a first positive slope erase pulse is applied to the Y electrodes. Thereafter, a second positive slope erase pulse is applied to the X electrodes. The above combination of the erase pulses also contributes to resetting the residual wall charges more certainly before the address selective discharge is carried out. Hence, the drive voltage margin can be improved.

Figure 27:
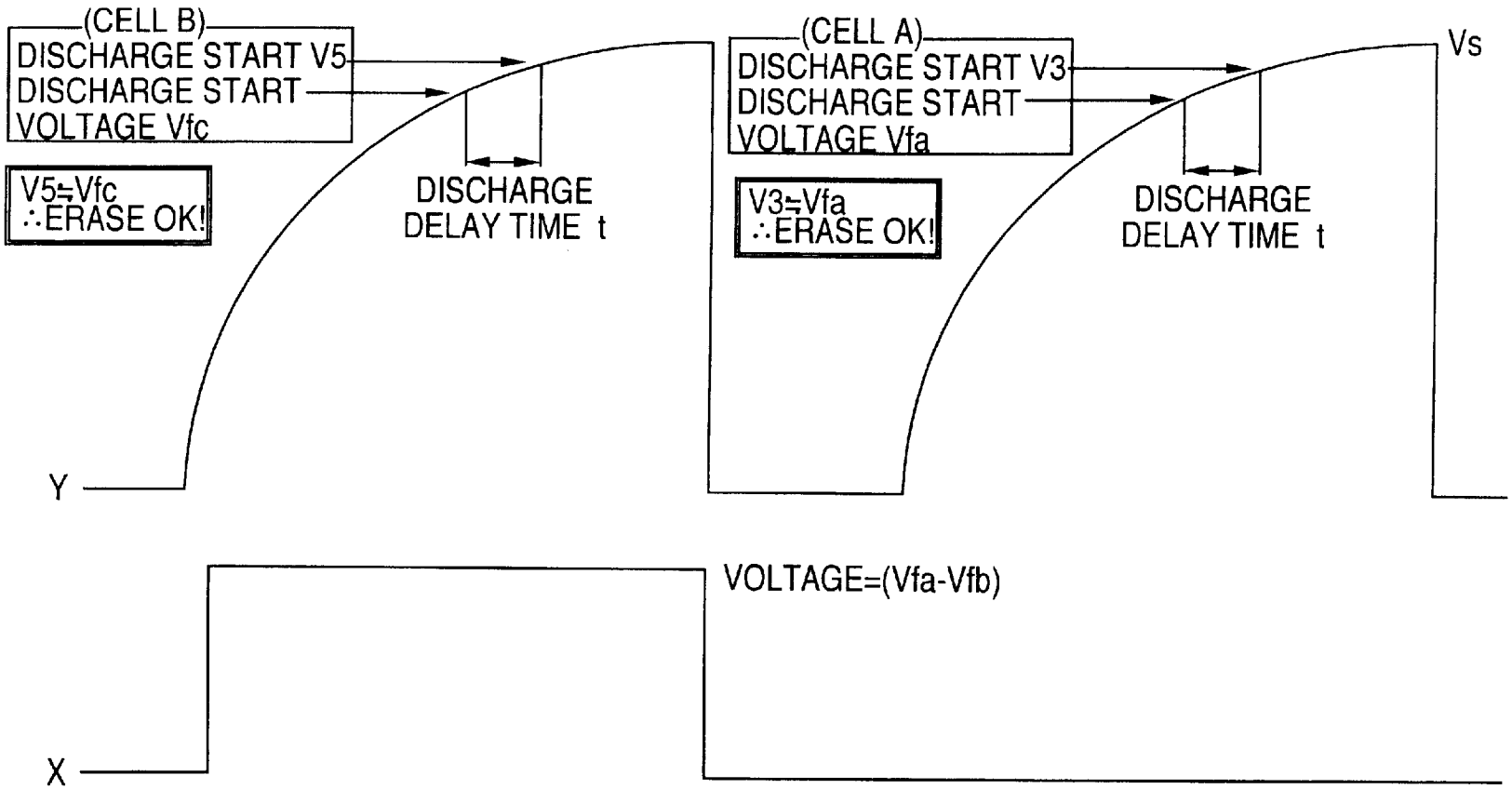
FIG. 27 is a waveform diagram showing the principle of nineteenth and twelfth embodiments of the present invention.

FIG. 27 is a waveform diagram which shows the principle of nineteenth and twentieth embodiments of the present invention. Within the reset period, two slope erase pulses are consecutively applied to the Y electrodes. The potential of the X electrodes involved in discharge is raised by a given level with respect to the first slope erase pulse, and is returned to the original level (0 V, for example) with respect to the second slope erase pulse. That is, the potential difference between the X and Y electrodes obtained when the first slope erase pulse is applied to the Y electrodes is less than that between the X and Y electrodes obtained when the second slope erase pulse is applied thereto.

A cell B has a discharge start voltage Vfc and a cell A has a discharge start voltage Vfa. If the potential of the X electrodes is not raised to the given level but is maintained at the original potential, the discharge start voltage Vfc of the cell B is located at a point located in a steeply portion of the slope erase pulse. A discharge delay time t it takes to actually start the discharge after the discharge start voltage is applied is constant. Hence, the discharge will actually be started at a voltage much higher than the discharge start voltage V. In this case, the wall charges cannot be erased completely or wall charges having the inverted polarity may be created. In short, it is required that there be a slight difference between the discharge start voltage and the voltage at which the discharge is actually started.

While the first positive slope erase pulse is applied, the potential of the X electrodes is raised by the given level. Hence, the discharge start voltage Vfc of the cell B is shifted to a gentle slope portion of the pulse waveform, and is approximately equal to the voltage at which the discharge is actually started.

It may be difficult to erase the wall charges of the cell A because the A has the comparatively high discharge start voltage Vfa (>Vfc). That is, the maximum potential difference between the X and Y electrodes obtained when the first positive slope erase pulse is applied to the X electrode is equal to Vs−(Vfa−Vfb) where Vs is the highest level of the first and second positive slope erase pulses, and is insufficient to reset the cell A. The second positive slope erase pulse is provided to erase the wall charges in the cells having comparatively high discharge starting voltages. Hence, as long as the second positive slope erase pulse is applied, the potential of the X electrodes is maintained at the original level (0 V, for example), so that the maximum potential difference between the X and Y electrodes can be increased (to Vs at maximum). Hence, the cells A can be reset certainly.

A description will be given of embodiments of the present invention based on the above principle.

Figure 28:
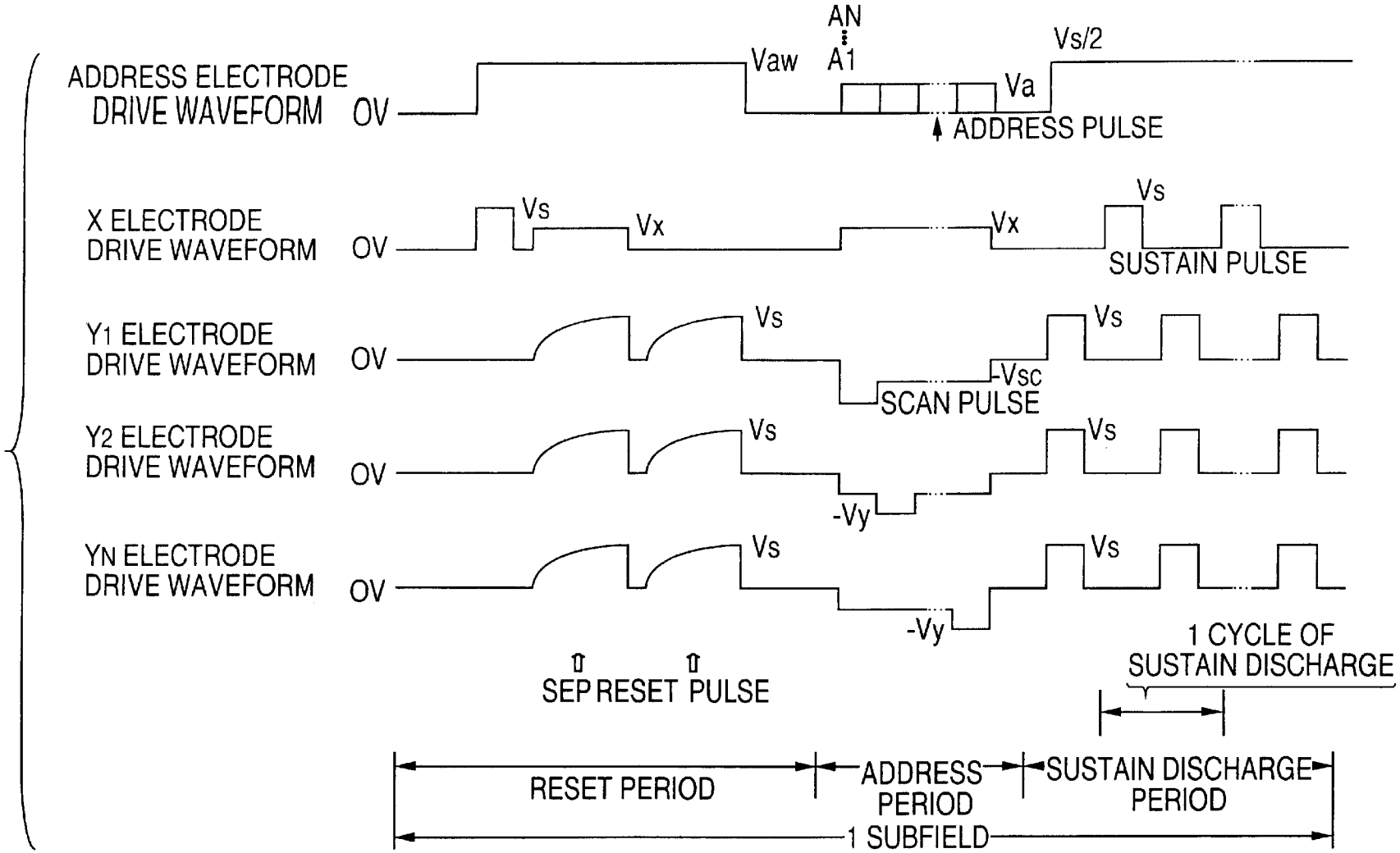
FIG. 28 is a waveform diagram of drive pulses according to the nineteenth embodiment of the present invention.

FIG. 28 is a waveform diagram of drive pulses according to the nineteenth embodiment of the present invention. As shown in FIG. 28, two consecutive slope erase pulses are applied to the Y electrodes $Y_1$−$Y_N$. The two slope erase pulses have an identical waveform. That is, the two slope erase pulses have an identical voltage slope. Alternatively, the two slope erase pulses may have different waveforms. During the discharge for erasing the wall charges, the Y electrodes serve as anode electrodes, and the X electrodes serve as cathode electrodes.

Within the reset period, the potential of the X electrodes is set to the aforementioned priming voltage Vx (used within the address period) while the first slope erase pulse is applied to the Y electrodes, and is set to 0 V while the second slope erase pulse is applied thereto. The use of the priming voltage Vx is attractive because there is no need to provide a new voltage source in practice. Of course, the potential of the x electrodes to be set while the first slope erase pulse is applied is not limited to the priming voltage but can be set to another appropriate voltage. The maximum potential difference between the X and Y electrodes is equal to Vs−Vw when the first slope erase pulse is applied, and is equal to Vs(>Vs−Vx) when the second slope erase pulse is applied.

Figure 29:
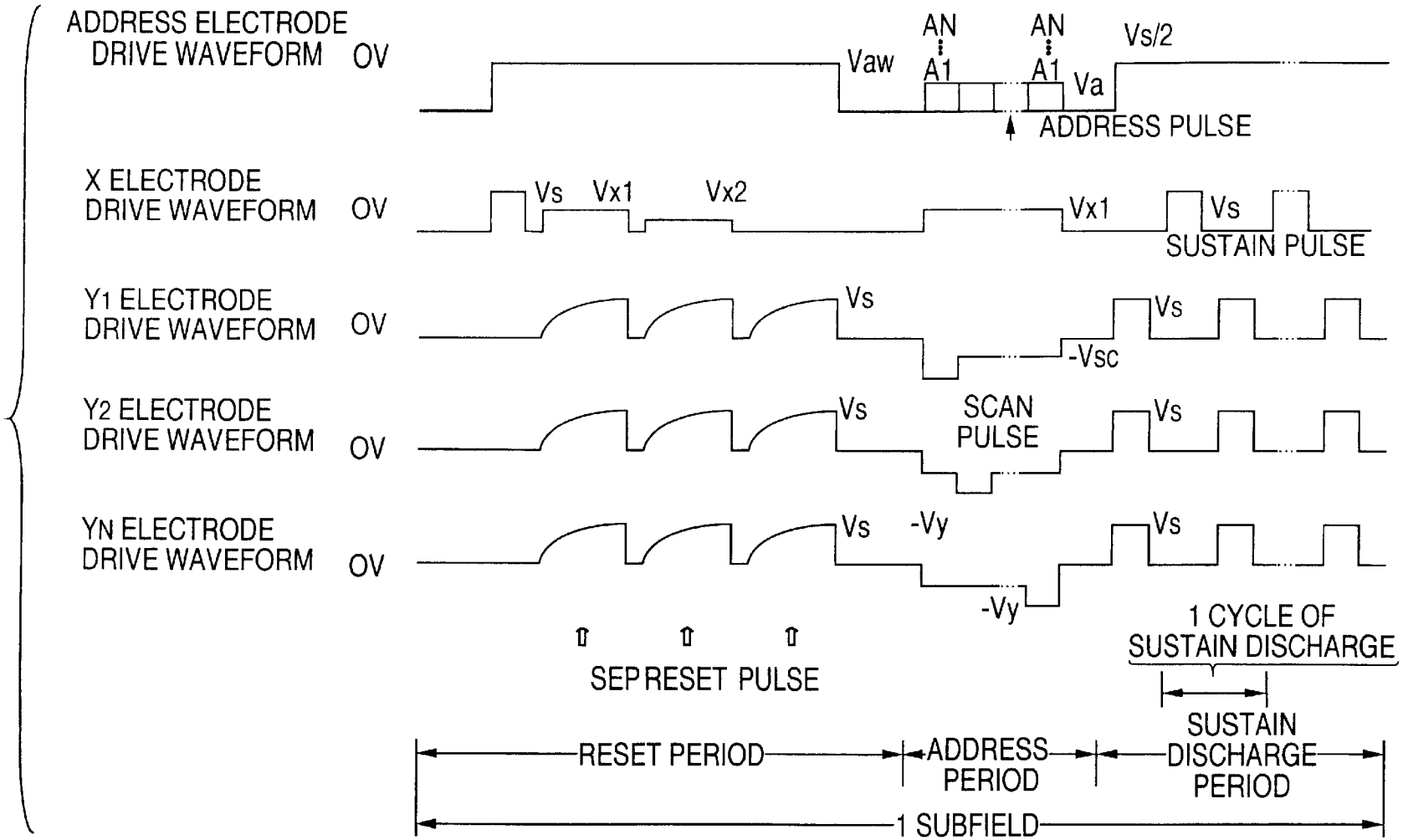
FIG. 29 is a waveform diagram of drive pulses according to a variation of the nineteenth embodiment of the present invention.

FIG. 29 shows a variation of the nineteenth embodiment of the present invention. The variation shown in FIG. 29 is characterized as follows. A third positive slope erase pulse is applied to the Y electrodes $Y_1$−$Y_N$. The potential of the X electrodes is set to Vx1 while the first slope erase pulse is applied, and is set to Vx2(Vx1>Vx2>0 V) while the second slope erase pulse is applied. While the third slope erase pulse is applied, the X electrodes are set to 0 V. Hence, the maximum potential difference between the X and Y electrodes can be increased in stepwise formation. Hence, all the cells can be reset more certainly. If Vx1=Vx, only a voltage source which generates the voltage Vx2 will be needed in practice.

Figure 30:
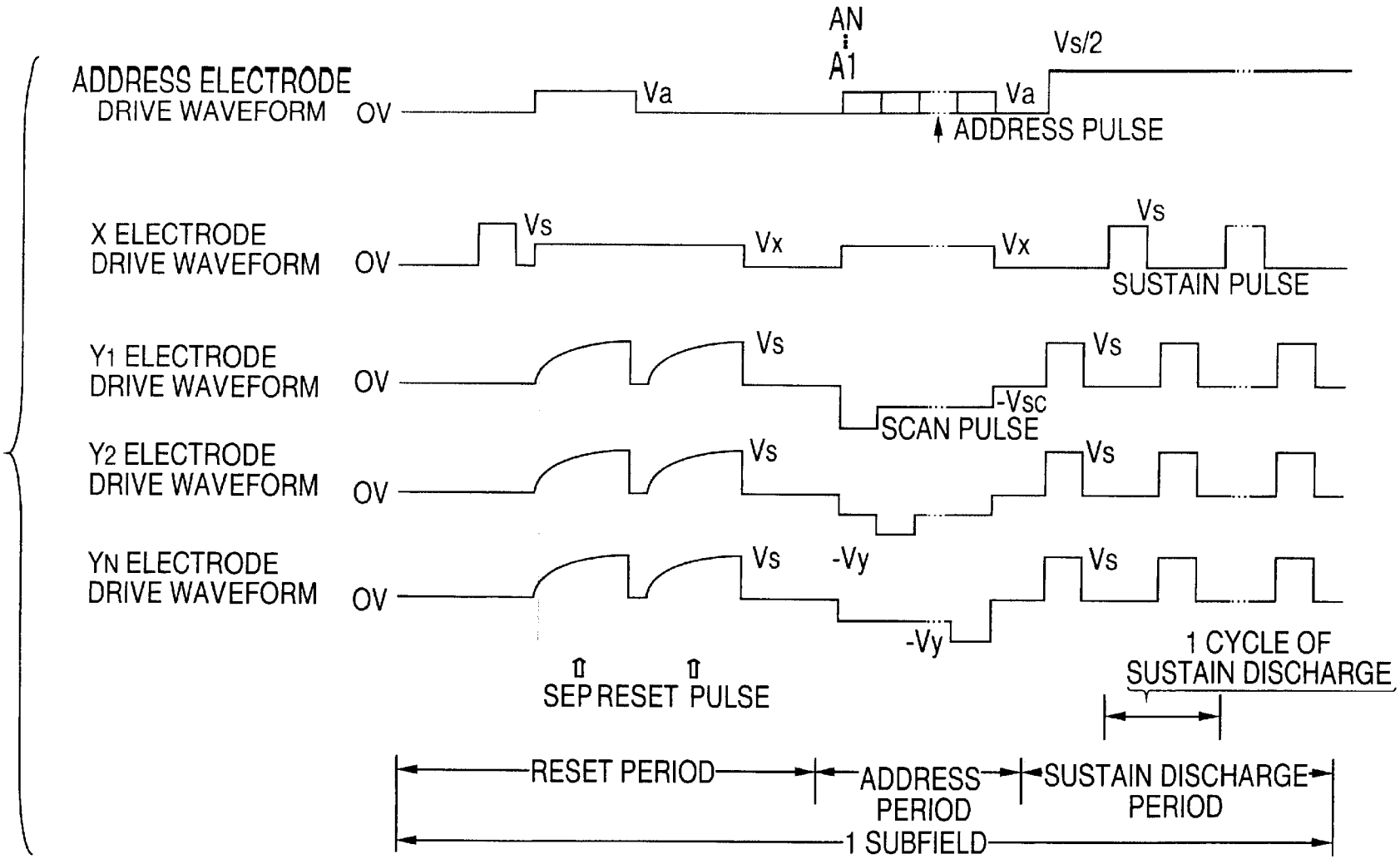
FIG. 30 is a waveform diagram of drive pulses according to the twentieth embodiment of the present invention.

A description will be given of the twentieth embodiment of the present invention with reference to FIG. 30. The present embodiment is directed to an arrangement in which a discharge is caused between the Y electrodes and the address electrodes in order to erase the wall charges. The Y electrodes serve as anode electrodes, and the address electrodes serve as cathode electrodes. The twentieth embodiment differs from the nineteenth embodiment in that the twentieth embodiment uses the address electrodes, not the x electrodes. However, the principle of the twentieth embodiment is the same as that of the nineteenth embodiment.

Within the reset period, two slope erase pulses are consecutively applied to the Y electrodes $Y_1$–$Y_N$. The two slope erase pulses have an identical waveform. That is, the two slope erase pulses have an identical voltage slope. Alternatively, the two slope erase pulses may have different waveforms.

The potentials of the address electrodes are set to the aforementioned address voltage Va while the first slope erase pulse is applied, and are set to 0 V for the second slope erase pulse is applied. When the address voltage Va is used, there is no need for a new voltage source in practice. However, the address electrodes may be set to an appropriate potential other than the address voltage Va while the first slope erase pulse is applied. The maximum potential difference between the address electrodes and the Y electrodes is equal to Vs−Va while the first slope erase pulse is applied, and is equal to Vs(>Vs−Va) while the second slope erase pulse is applied.

The potentials of the X electrodes within the period in which the slope erase pulses are consecutively applied thereto are set to Vx used within the address period.

Figure 31:
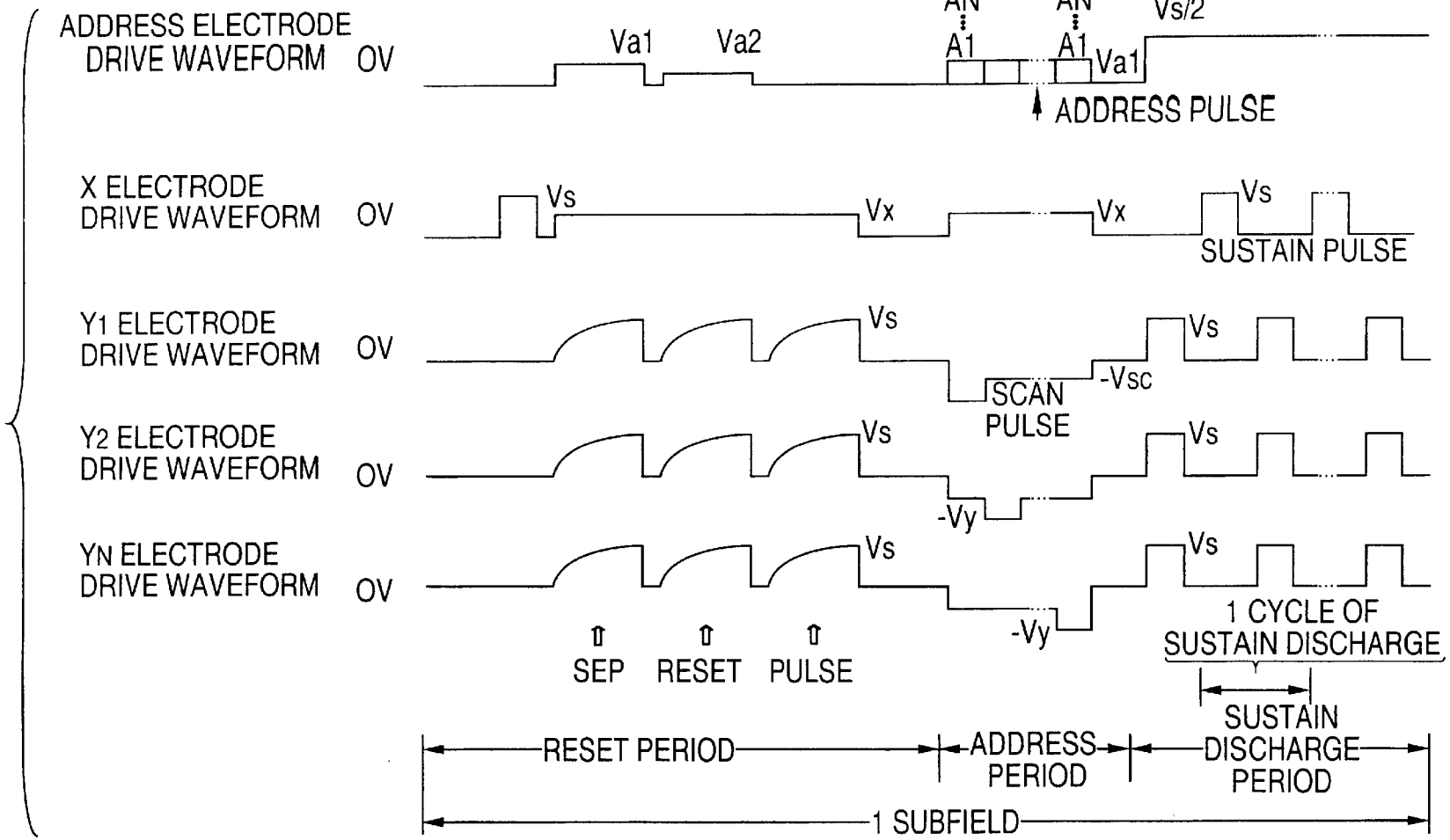
FIG. 31 is a waveform diagram of drive pulses according to a variation of the twentieth embodiment of the present invention.

FIG. 31 is a waveform diagram of drive pulses according to a variation of the twentieth embodiment of the present invention. In the present variation, three slope erase pulses are consecutively applied to the Y electrodes $Y_1$–$Y_N$. The potentials of the address electrodes are set to a voltage Va1 while the first slope erase pulse is applied to the Y electrodes, and are set to a voltage Va2(Va1>Va2>0 V) while the second slope erase pulse is applied thereto. Further, the potentials of the address electrodes are set to 0 V while the third slope erase pulse is applied to the Y electrodes. Hence, the maximum potential difference between the address electrodes and the Y electrodes are increased in stepwise formation. Hence, it is possible to reset all the cells more certainly. In this case, if Va1 is set equal to Va, it is required to newly generate only the voltage Vas.

Figure 32:
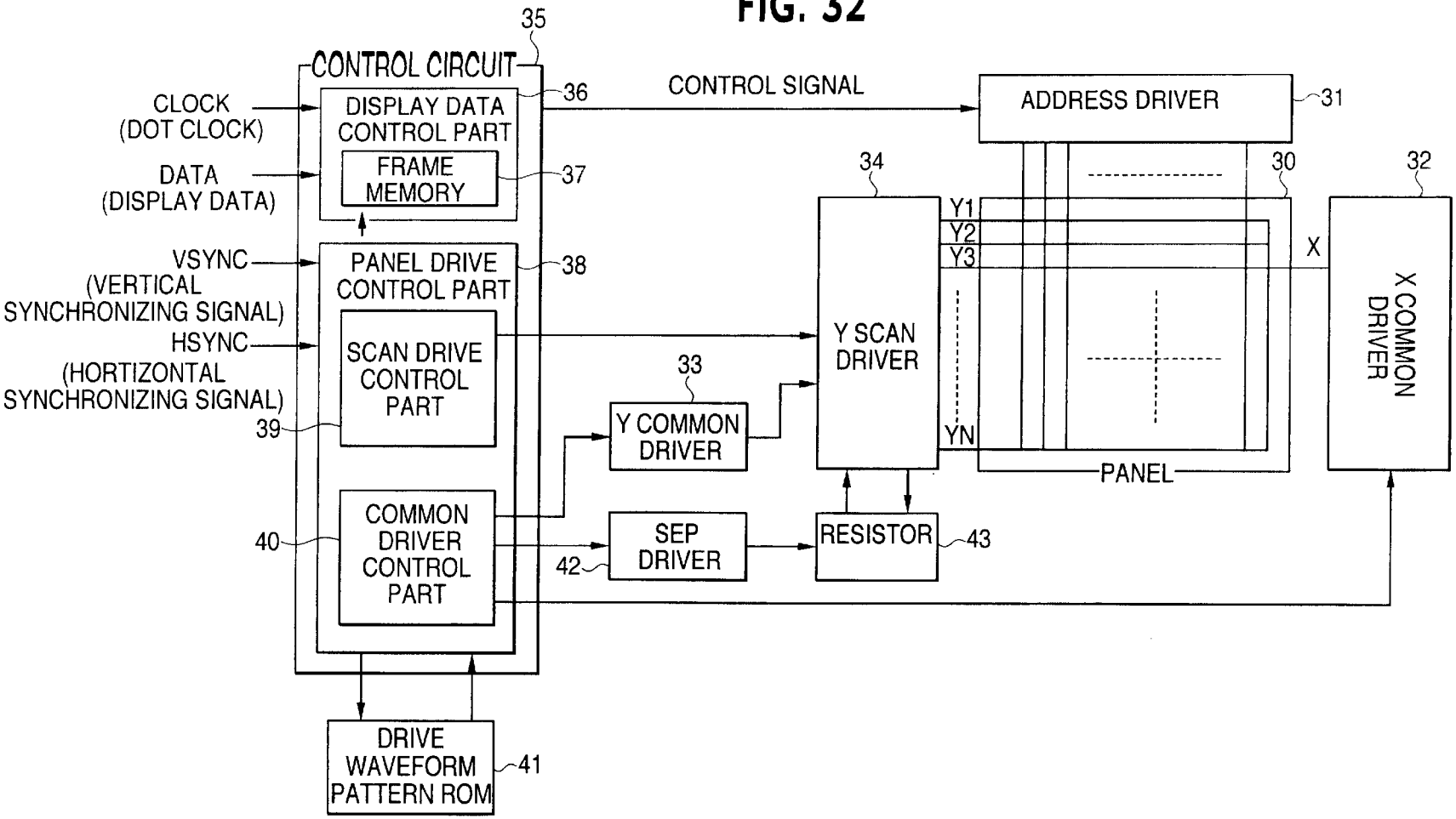
FIG. 32 is a block diagram of a plasma display driving apparatus according to an embodiment of the present invention.

FIG. 32 is a block diagram of a plasma display drive device configured according to the present invention. The apparatus shown in FIG. 32 drives the aforementioned triple-electrode surface discharge AC type plasma display.

The address electrodes are connected to an address driver 31, which apply the address pulses to the respective address electrodes at the time of the address discharge. The Y electrodes are connected to a Y scan driver 34, to which a Y common driver 33 is connected. The pulses at the time of the address discharge are generated by the Y scan driver 34. The sustain discharge pulses are generated by the Y common driver 33, and are applied to the Y electrodes via the Y scan driver 34.

An SEP (slope erase pulse) driver 42 applies the slope erase pulses to the Y electrodes via a resistor 43 and the Y scan driver 34. The waveforms of the slope erase pulses are determined by the resistance R of the resistor 43 and the panel capacitance C, and have an exponential curve defined by the following expression:

$$v=e^{-(t/CR)}.$$

The x electrodes are commonly connected and form respective display lines. An X common drier 32 generates the whole screen write pulse and the sustain discharge pulses.

The X common driver 32, the Y common driver 33 and the Y scan driver 34 are controlled by a control circuit 35, which is controlled by synchronizing signals (a vertical synchronizing signal VSYNC and a horizontal synchronizing signal HSYNC) and a display data signal DATA, these signals being externally supplied.

The control circuit 35 includes a display data control part 36 and a panel drive control part 38. A drive waveform pattern ROM 41 is connected to the control part 35. The display data DATA externally supplied is stored in a frame memory 37 within the display data control part 36 in synchronism with a dot clock CLOCK externally supplied, and is then output to the address driver 31 as a control signal. The panel drive control part 38 is equipped with a scan driver control part 39 and a common driver control part 40. The panel drive control part 38 operates in synchronism with the vertical synchronizing signal VSYNC and the horizontal synchronizing signal HYSNC and in accordance with waveform data of drive pulses stored in the drive waveform pattern ROM 41. The drive waveform pattern ROM 41 stores patterns of the drive pulses applied to the address electrodes, the X electrodes and the Y electrodes in any of the aforementioned first through twentieth embodiments of the present invention. The panel drive control part 38 reads the waveform data from the drive waveform pattern ROM 41 in accordance with the vertical synchronizing signal VYSNC and the horizontal synchronizing signal HYSNC, and thus controls the drivers 32, 33, 34 and 42.

The aforementioned embodiments of the present invention and variations thereof can arbitrarily be combined.

According to the present invention, the following advantages can be obtained.

In the high-contrast driving in which the erase discharge is caused only during the reset period except for some subfields, an improved drive voltage margin can be obtained by applying the narrow-width pulse which erases only the cells which are lighted in the immediately previous subfield.

More particularly, it is possible to avoid a large number of minus charges from being accumulated due to the influence of the address electrodes and to perform the erasing more completely.

In the erase operation during the reset period, the almost complete erasing operation can be realized without any failure in erasing.

It is also possible to prevent occurrence of a failure in erasing during the reset period caused by a very weak discharge after the last sustain discharge pulse falls.

It is also possible to erase the charges more completely even if a very weak discharge takes place after the last sustain discharge pulse falls.

It is also possible to erase the electrodes on the address electrodes due to the whole screen write/self-erasing pulse applied within the reset period.

It is also possible to minimize the influence of the residual wall charges accumulated on the address electrodes during the sustain discharge period and to thus perform the erasing operation more completely.

By consecutively applying a plurality of reset or erase pulses to given electrodes, it is possible to erase the wall charges in the cells having different discharge start voltages more stably and more certainly at the voltages close to the respective discharge start voltages.

The different maximum potential differences between the three different electrodes are defined, so that the wall charges of the cells having the different discharge start voltages can stably and certainly be reset at voltages close to the respective discharge start voltages.

It is also possible to simply configure a circuit which generates the reset pulses.

It is also possible to reset cells having comparatively low discharge start voltages first and then reset remaining cells having comparatively high discharge star voltages second.

It is possible to simply configure a circuit which controls the X and Y electrodes.

The present invention is not limited to the specifically disclosed embodiments, and variations and modifications may be made without departing from the scope of the present invention.

What is claimed is:

1. A method for driving a plasma display panel having first and second plates opposite each other, wherein first and second electrodes are formed on the first plate in parallel and third electrodes are formed on the second plate so as to cross the first and second electrodes, and wherein one frame of an image includes n subfields, and each of the n subfields includes a reset period in which an erase discharge is performed, an address period in which a distribution of wall charges depending on data to be displayed is formed and a sustain discharge period in which a sustain discharge, based on the distribution of the wall charges formed in the address period, is performed by repeatedly applying a sustain discharge pulse, said method comprising:

applying, within a subfield among the n subfields, a narrow-width pulse having a pulse width equal to or less than 2 $\mu$s to the first electrodes in order to cause the erase discharge; and applying a voltage pulse to the third electrodes so that the voltage pulse falls at the same time that the narrow-width pulse falls.

2. The method as claimed in claim 1, wherein:

the n subfields include a subfield A during which a whole screen discharge and the erase discharge are both caused, and a subfield B during which the erase discharge is caused without causing the whole screen discharge; and the erase discharge during the reset period of at least the subfield B is caused by the narrow-width pulse.

3. A method for driving a plasma display panel having first and second plates opposite each other, wherein first and second electrodes are formed on the first plate in parallel and third electrodes are formed on the second plate so as to cross the first and second electrodes, and wherein one frame of an image includes n subfields, and each of the n subfields includes a reset period in which an erase discharge is performed, an address period in which a distribution of wall charges depending on data to be displayed is formed and a sustain discharge period in which a sustain discharge, based on the distribution of the wall charges formed in the address period, is performed by repeatedly applying a sustain discharge pulse, said method comprising:

applying, within the reset period, a narrow-width pulse having a pulse width equal to or less than 2 $\mu$s to the first electrodes in order to cause a first erase discharge; and applying, within the reset period, an erase-pulse to the second electrodes in order to cause a second erase discharge, the erase pulse continuously changing a voltage applied to the second electrodes.

4. The method as claimed in claim 3, wherein an interval between the narrow-width pulse and the erase pulse is equal to or greater than 10 $\mu$s.

5. A method for driving a plasma display panel having first and second plates opposite each other, wherein first and second electrodes are formed on the first plate in parallel and third electrodes are formed on the second plate so as to cross the first and second electrodes and define plural corresponding display cells, and wherein one frame of an image includes n subfields, and each of the n subfields includes a reset period for initializing each of the plural display cells, an address period in which a distribution of wall charges depending on data to be displayed is formed and a sustain discharge period in which a sustain discharge, based on the distribution of the wall charges formed in the address period, is performed wherein the n subfields include a subfield A, during which both a whole screen discharge and an erase discharge are caused, and a subfield B, during which an erase discharge is caused without causing the whole screen discharge, said method comprising:

repeatedly applying, within the sustain period of a given subfield immediately preceding the subfield B, sustain discharge pulses including a first sustain discharge pulse and a second sustain discharge pulse, the second sustain discharge pulse having a pulse width longer than a pulse width of the first sustain discharge pulse and the second sustain discharge pulse being disposed at an end of the sustain discharge period

6. The method as claimed in claim 5, wherein a potential, having a same level as that of a voltage pulse applied to the third electrodes in the address period, is applied to the third electrodes within the sustain discharge period.

7. A method for driving a plasma display panel having first and second plates opposite each other, wherein first and second electrodes are formed on the first plate in parallel and third electrodes are formed on the second plate so as to cross the first and second electrodes and define plural corresponding display cells, and wherein one frame of an image includes n subfields, and each of the n subfields includes a reset period in which an erase discharge is performed, an address period in which a distribution of wall charges depending on data to be displayed is formed and a sustain discharge period in which a sustain discharge, based on the distribution of the wall charges formed in the address period, is performed by repeatedly applying a sustain discharge pulse, said method comprising:

applying, within a given subfield among the n subfields, an erase pulse for causing the erase discharge within the reset period at a first interval from a last sustain discharge pulse in the subfield immediately preceding the given subfield, said first interval being equal to a second interval during which sustain discharge pulses repeatedly applied.

8. The method as claimed in claim 7, wherein:

the n subfields include a subfield A during which a whole screen discharge and the erase discharge are both caused, and a subfield B during which the erase discharge is caused without causing the whole screen discharge; and said given subfield corresponds to the subfield B.

9. The method as claimed in claim 7, wherein an interval between the erase pulse in the given subfield and the last sustain discharge pulse immediately preceding said given subfield is equal to or less than 2 $\mu$s.

10. The method as claimed in claim 7, wherein a potential having a same level as that of a voltage pulse applied to the third electrodes in the address period is applied to the third electrodes within the sustain discharge period.

11. A method for driving a plasma display panel having first and second plates opposite each other, wherein first and second electrodes are formed on the first plate in parallel and third electrodes are formed on the second plate so as to cross the first and second electrodes and define plural corresponding display cells, and wherein one frame of an image includes a reset period for initializing each of the display cells, an address period in which a distribution of wall charges depending on data to be displayed is formed and a sustain discharge period in which a sustain discharge, based on the distribution of the wall charges formed in the address period, is performed by repeatedly applying a sustain discharge pulse, said method comprising:

applying a voltage pulse to the third electrodes so that a potential of the third electrodes is maintained at a predetermined level within the sustain discharge period and the voltage pulse falls at the same time as a last sustain discharge pulse falls within the sustain discharge period.

12. The method as claimed in claim 11, wherein said method comprises:

repeatedly applying the sustain discharge pulse within the sustain discharge period at an interval equal to or less than 1 $\mu$s.

13. A method for driving a plasma display panel having first and second plates opposite each other, wherein first and second electrodes are formed on the first plate in parallel and third electrodes are formed on the second plate so as to cross the first and second electrodes, and wherein one frame of an image includes n subfields, and each of the n subfields includes a reset period in which an erase discharge is performed, an address period in which a distribution of wall charges depending on data to be displayed is formed and a sustain discharge period in which a sustain discharge, based on the distribution of the wall charges formed in the address period, is performed by repeatably applying a sustain discharge pulse, wherein the n subfields include a subfiled A during which a whole screen discharge and an erase discharge are both caused, and a subfield B during which the erase discharge is caused without causing the whole screen discharge, said method comprising:

causing, within the reset period of the subfield A among the n subfields, a first erase discharge, the whole screen discharge, and a second erase discharge in that order.

14. The method as claimed in claim 13, wherein the first erase discharge before the whole screen discharge is caused by applying a narrow-width pulse having a pulse width equal to or less than 2 $\mu$s to the first electrodes or applying an erase pulse having a continuously changing voltage, to the second electrodes or by applying both the narrow-width pulse and the erase pulse.

15. The method as claimed in claim 14, wherein a voltage pulse is applied to the third electrodes corresponding to the erase pulse having a continuously changing voltage applied to the second electrodes within the reset period.

16. The method as claimed in claim 15, wherein the first erase discharge is caused before the whole screen discharge is caused, and a voltage of 0 V is applied to the third electrodes when the first erase discharge is caused.

17. The method as claimed in claim 13, wherein:

the first erase discharge is caused before the whole screen discharge is caused; and a voltage of 0 V is applied to the third electrodes when the first erase discharge is caused.

18. A method for driving a plasma display panel having first and second plates opposite each other, wherein first and second electrodes are formed on the first plate in parallel and third electrodes are formed on the second plate so as to cross the first and second electrodes, and wherein one frame of an image includes a reset period in which an erase discharge is performed, an address period in which a distribution of wall charges, depending on data to be displayed, is formed and a sustain discharge period in which a sustain discharge, based on the distribution of the wall charges formed in the address period, is performed by repeatedly applying a sustain discharge pulse, said method comprising:

applying, within the reset period which includes a whole screen discharge and the erase discharge, a narrow-width pulse having a length equal to or less than 2 $\mu$s to the third electrode after a whole screen pulse, causing the whole screen discharge, falls.

19. The method as claimed in claim 17, wherein the narrow-width pulse is applied to the third electrodes within 10 $\mu$s after the whole screen pulse falls.

20. The method as claimed in claim 17, further comprising applying, within the reset period, an erase pulse having a continuously changing voltage to the second electrodes after the whole screen pulse falls.

21. A method for driving a plasma display panel having first and second plates opposite each other, wherein first and second electrodes are formed on the first plate in parallel and third electrodes are formed on the second plate so as to cross the first and second electrodes, and wherein one frame of an image includes n subfields and a pause period during which no drive pulses are output, and each of the n subfields includes a reset period in which an erase discharge is performed, an address period in which a distribution of wall charges depending on data to be displayed is formed and a sustain discharge period in which a sustain discharge, based on the distribution of the wall charges formed in the address period, is performed by repeatedly applying a sustain discharge pulse, said method comprising:

causing, within the reset period of a subfield A among the n subfields, both a whole screen discharge and the erase discharge and, within the reset period of a subfield B among the n subfields, the erase discharge without the whole screen discharge; and said pause period being a self-erasing period for causing the erase discharge, after a whole screen pulse for causing the whole screen discharge, within the subfield A.

22. A method for driving a plasma display panel having first and second plates opposite each other, wherein first and second electrodes are formed on the first plate in parallel and third electrodes are formed on the second plate so as to cross the first and second electrodes, and wherein one frame of an image includes n subfields, and each of the n subfields includes a reset period in which an erase discharge is performed, an address period in which a distribution of wall charges depending on data to be displayed is formed and a sustain discharge period in which a sustain discharge, based on the distribution of the wall charges formed in the address period, is performed by repeatedly applying a sustain discharge pulse, said method comprising:

applying, within the reset period, a plurality of erase pulses including an erase pulse having a continuously changing voltage so that a narrow-width pulse having a pulse width equal to or less than 2 $\mu$s is applied to the first electrode, a first erase pulse having a continuously changing voltage in a positive direction is applied to the second electrode after the narrow-width pulse is applied, and then a second erase pulse, having a continuously changing voltage in a negative direction, or an erase pulse in the negative direction is applied to the second electrodes.

23. A method for driving a plasma display panel having first and second plates opposite each other, wherein first and second electrodes are formed on the first plate in parallel and third electrodes are formed on the second plate so as to cross the first and second electrodes, and wherein one frame of an image includes n subfields, and each of the n subfields includes a reset period in which an erase discharge is performed, an address period in which a distribution of wall charges depending on data to be displayed is formed and a sustain discharge period in which a sustain discharge, based on the distribution of the wall charges formed in the address period, is performed by repeatedly applying a sustain discharge pulse, said method comprising:

applying, within the reset period, a plurality of erase pulses including erase pulses continuously changing a voltage thereof so that a narrow-width pulse having a pulse width equal to or less than 2 $\mu$s is applied to the first electrode, a first erase pulse continuously changing the voltage thereof in a positive direction is applied to the second electrode after the narrow-width pulse is applied, and then a second erase pulse continuously changing a voltage thereof in a negative direction is applied to the second electrodes.

24. The method as claimed in claim 23, further comprising the step of applying a third erase pulse continuously changing the voltage in the positive direction.

25. The method as claimed in claim 24, wherein an n+1th erase pulse has a pulse width longer than that of an nth erase pulse.

26. A method for driving a plasma display panel having first and second plates opposite each other, wherein first and second electrodes are formed on the first plate in parallel and third electrodes are formed on the second plate so as to cross the first and second electrodes, and wherein one frame of an image includes n subfields, and each of the n subfields includes a reset period in which an erase discharge is performed, an address period in which a distribution of wall charges depending on data to be displayed is formed and a sustain discharge period in which a sustain discharge, based on the distribution of the wall charges formed in the address period, is performed by repeatedly applying a sustain discharge pulse, said method comprising:

applying, within the reset period, a plurality of reset pulses which erase wall charges and have a continuously changing voltage, to any of the first, second and third electrodes in order to cause a discharge at a voltage close to a discharge start voltage.

27. The method as claimed in claim 26, wherein the plurality of reset pulses are applied to the second electrodes, further comprising:

setting the potentials of the first electrodes to different potentials respectively corresponding to the plurality of reset pulses.

28. The method as claimed in claim 27, further comprising:

applying the plurality of reset pulses to the second electrodes; and setting the first voltages to different potentials respectively corresponding to the plurality of reset pulses.

29. The method as claimed in claim 28, wherein a maximum potential difference between the first and second electrodes in response to an n+1th reset pulse, among the plurality of reset pulses, is greater than that in response to an nth reset pulse among the plurality of reset pulses.

30. The method as claimed in claim 26, wherein the plurality of reset pulses are applied to the second electrodes, further comprising:

setting the potentials of the third electrodes to different potentials respectively corresponding to the plurality of reset pulses.

31. The method as claimed in claim 27, further comprising:

applying the plurality of reset pulses to the second electrodes; and setting the potentials of the third electrodes to different potentials respectively corresponding to the plurality of reset pulses.

32. The method as claimed in claim 31, wherein a maximum potential difference between the second and third electrodes in response to an n+1th reset pulse, among the plurality of reset pulses, is greater than that in response to an $n^{th}$ reset pulse among the plurality of reset pulses.

33. The method as claimed in claim 31, wherein at least one of the potentials of the third electrodes, based on the respective reset pulses, is equal to a potential of the third electrodes set during the address period.

34. A device adapted to a plasma display panel having first and second plates opposite each other, wherein first and second electrodes are formed on the first plate in parallel and third electrodes are formed on the second plate so as to be orthogonal to the first and second electrodes, said device comprising:

a first control part which drives the plasma display panel wherein one frame of image includes n subfields, and each of the n subfields includes a reset period for causing an erase discharge in display cells of the panel, an address period for forming a distribution of wall charges in the display cells, and a sustain discharge period for causing a sustain discharge based on the distribution of the wall charges formed during the address period by repeatedly applying a sustain discharge pulse to the panel; and a second control part which applies, within the reset period, a plurality of reset pulses which erase wall charges and have a continuously changing a voltage to any of the first, second and third electrodes in order to cause a discharge at a voltage close to a discharge start voltage.

35. A method for driving a plasma display panel having first and second plates opposite each other, wherein first and second electrodes are formed on the first plate in parallel and third electrodes are formed on the second plate so as to cross the first and second electrodes, and wherein one frame of an image includes n subfields, and each of the n subfields includes a reset period in which an erase discharge is performed, an address period in which a distribution of wall charges depending on data to be displayed is formed and a sustain discharge period in which a sustain discharge, based on the distribution of the wall charges formed in the address period, is performed by repeatedly applying a sustain discharge pulse, said comprising:

applying, within the reset period, a narrow-width pulse having a pulse width equal to or less than 2 $\mu$s in order to cause a first erase discharge; and applying, within the reset period, an erase pulse having a continuously changing voltage in order to cause a second erase discharge.

36. The method as claimed in claim 35, wherein a voltage pulse, having a same third potential as that applied to the third electrodes in the address period, is applied to the third electrodes corresponding to the erase pulse.

37. A method for driving a plasma display panel having first and second plates opposite each other, wherein first and second electrodes are formed on the first plate in parallel and third electrodes are formed on the second plate so as to cross the first and second electrodes, and wherein one frame of an image includes n subfields, and each of the n subfields includes a reset period for initializing each of the display cells, an address period in which a distribution of wall charges depending on data to be displayed is formed and a sustain discharge period in which a sustain discharge, based on the distribution of the wall charges formed in the address period, is performed, wherein the n subfields include a subfield A during which a whole screen discharge and an erase discharge are both caused, and a subfield B during which the erase discharge is caused without causing the whole screen discharge, said method comprising:

repeatedly applying, within the sustain period of a given subfield immediately preceding the subfield B, sustain discharge pulses to the second electrodes including a first sustain discharge pulse and a second sustain discharge pulse, the second sustain discharge pulse having a pulse width longer than a pulse width of the first sustain discharge pulse, and the second sustain discharge pulse being disposed at an end of the sustain discharge period.

38. The method as claimed in claim 37, wherein a potential having the same level as that of a voltage pulse applied to the third electrodes in the address period is applied to the third electrodes within the sustain discharge period.

39. A method for driving a plasma display panel having first and second plates opposite each other, wherein first and second electrodes are formed on the first plate in parallel and third electrodes are formed on the second plate so as to cross the first and second electrodes, and wherein one frame of an image includes n subfields, and each of the n subfields includes a reset period in which an erase discharge is performed, an address peroid in which a distribution of wall charges depending on data to be displayed is formed and a sustain discharge period in which a sustain discharge, based on the distribution of the wall charges formed in the address period, is performed, said method comprising:

repeatedly applying, within the sustain period of a given subfield among the n subfields sustain discharge pulses including a first sustain discharge pulse and a second sustain discharge pulse, the second sustain discharge pulse having a pulse width longer than a pulse width of the first sustain discharge pulse, and the second sustain discharge pulse being disposed at an end of the sustain discharge period; and applying, within the reset period of a subfield immediately following the given subfield, a narrow-width pulse having a pulse width equal to or less than 2 $\mu$s in order to cause the erase discharge.

40. A method for driving a plasma display panel having first and second plates opposite each other, wherein first and second electrodes are formed on the first plate in parallel and third electrodes are formed on the second plate so as to cross the first and second electrodes, and wherein one frame of an image includes a reset period for initializing each of display cells, an address period in which a distribution of wall charges depending on data to be displayed is formed and a sustain discharge period in which a sustain discharge, based on the distribution of the wall charges formed in the address period, is performed, said method comprising:

repeatedly applying, within the sustain period, sustain discharge pulses including first, second and third sustain discharge pulses, both the second sustain discharge pulse and the third sustain discharge pulse having a pulse width longer than a pulse width of the first sustain discharge pulse, and the second sustain discharge pulse being disposed at an end of the sustain discharge period and the third sustain discharge pulse being disposed at a start of the sustain discharge period.

41. A method for driving a plasma display panel having first and second plates opposite each other, wherein first and second electrodes are formed on the first plate in parallel and third electrodes are formed on the second plate so as to cross the first and second electrodes, and wherein one frame of an image includes a reset period in which an erase discharge is performed, an address period in which a distribution of wall charges depending on data to be displayed is formed and a sustain discharge period in which a sustain discharge, based on the distribution of the wall charges formed in the address period, is performed by repeatedly applying a sustain discharge pulse, said method comprising:

causing, within the reset period, a first erase discharge, a whole screen discharge, and a second erase discharge in that order, wherein the first erase discharge includes one erase discharge produced by applying a narrow-width pulse having a pulse width equal to or less than 2 $\mu$s to the first electrodes and another erase discharge produced by applying an erase pulse having a continuously changing voltage to the second electrodes.

42. The method as claimed in claim 41, wherein a voltage pulse is applied to the third electrodes corresponding to the erase pulse having a continuously changing voltage applied to the second electrodes within the reset period.

43. A method for driving a plasma display panel having first and second plates opposite each other, wherein first and second electrodes are formed on the first plate in parallel and third electrodes are formed on the second plate so as to cross the first and second electrodes, and wherein one frame of an image includes n subfields, and each of the n subfields includes a reset period in which an erase discharge is performed, an address period in which a distribution of wall charges depending on data to be displayed is formed and a sustain discharge period in which a sustain discharge, based on the distribution of the wall charges formed in the address period, is performed by repeatedly applying a sustain discharge pulse, said method comprising:

causing, within the reset period, a plurality of erase discharges by applying a plurality of erase pulses including an erase pulse having a continuously changing voltage so that a first erase discharge is caused by applying a narrow-width pulse having a pulse width equal to or less than 2$\mu$s; a second erase discharge is caused by a rising pulse edge having a continuously changing voltage after the first erase discharge is caused, and then a third erase discharge is caused by a falling pulse edge having a continuously changing voltage.

44. A method for driving a plasma display panel having first and second plates opposite each other, wherein first and second electrodes are formed on the first plate in parallel and third electrodes are formed on the second plate so as to cross the first and second electrodes, and wherein one frame of an image includes n subfields, and each of the n subfields includes a reset period in which an erase discharge is performed, an address period in which a distribution of wall charges depending on data to be displayed is formed and a sustain discharge period in which a sustain discharge, based on the distribution of the wall charges formed in the address period, is performed by repeatedly applying a sustain discharge pulse, said method comprising:

applying, within the reset period, a plurality of erase pulses including erase pulses having a continuously changing voltage so that a narrow-width pulse having a pulse width equal to or less than 2 $\mu$s is applied, and a first erase pulse having a continuously changing voltage in a positive direction is applied after the narrow-width pulse is applied; and then a second erase pulse having a continuously changing voltage in the positive direction is applied.

45. A method for driving a plasma display panel having first and second plates opposite each other, wherein first and second electrodes are formed on the first plate in parallel and third electrodes are formed on the second plate so as to cross the first and second electrodes, and wherein one frame of an image includes n subfields, and each of the n subfields includes a reset period in which an erase discharge is performed, an address period in which a distribution of wall charges depending on data to be displayed is formed and a sustain discharge period in which a sustain discharge, based on the distribution of the wall charges formed in the address period, is performed by repeatedly applying a sustain discharge pulse, wherein the n subfields include a subfield A during which both a whole screen discharge and an erase discharge are caused, and a subfield B during which the erase discharge is caused without causing the whole screen discharge, said method comprising;

applying, within the reset period of the subfield B among the n subfields, a reset pulse which erases wall charges and has a continuously changing voltage.

46. The method as claimed in claim 45, wherein a pulse having a predetermined voltage is applied to the third electrodes when the reset pulse is applied.

47. A method for driving a plasma display panel having first and second plates opposite each other, wherein first and second electrodes are formed on the first plate in parallel and third electrodes are formed on the second plate so as to cross the first and second electrodes, and wherein one frame of an image includes a reset period for initializing each of display cells, an address period in which a distribution of wall charges depending on data to be displayed is formed and a sustain discharge period in which a sustain discharge, based on the distribution of the wall charges formed in the address period, is performed by repeatedly applying a sustain discharge pulse, said method comprising:

applying a voltage pulse to the third electrodes so that a potential of the third electrodes is maintained at a predetermined level within the sustain discharge period and the voltage pulse falls at the same time as a last sustain discharge pulse, applied to the second electrodes, falls within the sustain discharge period.

48. A method for driving a plasma display panel wherein one frame of an image includes n subfields, and each of the n subfields includes a reset period in which an erase discharge is performed, an address period in which a distribution of wall charges depending on data to be displayed is formed and a sustain discharge period in which a sustain discharge, based on the distribution of the wall charges formed in the address period, is performed by repeatedly applying a sustain discharge pulse, and wherein the n subfields include a subfield A during which a whole screen discharge and an erase discharge are both caused, and a subfield B during which the erase discharge is caused without causing the whole screen discharge, said method comprising:

applying, within the reset period of the subfield B, a first erase pulse having a continuously changing voltage in a positive direction;

applying a second erase pulse having a continuously changing voltage in a negative direction or a second erase pulse in the negative direction after the first erase pulse is applied; and applying a third erase pulse having a continuously changing voltage in the positive direction after the second erase pulse is applied.

49. A method for driving a plasma display panel having first and second plates opposite each other, wherein first and second electrodes are formed on the first plate in parallel and third electrodes are formed on the second plate so as to cross the first and second electrodes, and wherein one frame of an image includes n subfields, and each of the n subfields includes a reset period in which an erase discharge is performed, an address period in which a distribution of wall charges depending on data to be displayed is formed and a sustain discharge period in which a sustain discharge, based on the distribution of the wall charges formed in the address period, is performed by repeatedly applying a sustain discharge pulse, wherein the n subfields include a subfield A during which both a whole screen discharge and an erase discharge are caused, and a subfield B during which the erase discharge is caused without causing the whole screen discharge, said method comprising:

applying, within the reset period of the subfield B among the n subfields, a plurality of reset pulses which erase wall charges and have a continuously changing voltage.

* * * * *